US009841704B2

(12) United States Patent
Matsumoto et al.

(10) Patent No.: US 9,841,704 B2
(45) Date of Patent: Dec. 12, 2017

(54) DEVELOPING DEVICE HAVING ROTATING FEEDING MEMBER

(75) Inventors: Atsushi Matsumoto, Toride (JP); Kyosuke Takahashi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 137 days.

(21) Appl. No.: 13/448,776

(22) Filed: Apr. 17, 2012

(65) Prior Publication Data

US 2012/0269555 A1 Oct. 25, 2012

(30) Foreign Application Priority Data

Apr. 20, 2011 (JP) ..... 2011-093902
Mar. 22, 2012 (JP) ..... 2012-065896

(51) Int. Cl.
*G03G 15/08* (2006.01)

(52) U.S. Cl.
CPC . *G03G 15/0893* (2013.01); *G03G 2215/0833* (2013.01); *G03G 2215/0838* (2013.01)

(58) Field of Classification Search
CPC ..... G03G 15/0891; G03G 2215/0827; G03G 2215/0833
USPC ..... 399/254, 255, 256
See application file for complete search history.

(56) References Cited

U.S. PATENT DOCUMENTS 4,477,173 A * 10/1984 Kozuka et al. ..... 399/255
4,576,466 A * 3/1986 Fukuchi et al. ..... 399/256
5,692,831 A * 12/1997 Campbell ..... 366/325.2
7,881,640 B2 * 2/2011 Iwata et al. ..... 399/254
7,991,332 B2 8/2011 Sakamaki
2007/0231015 A1 10/2007 Sakamaki
2010/0124442 A1 * 5/2010 Hatakeyama et al. ..... 399/254
2010/0226688 A1 * 9/2010 Soga ..... 399/254
(Continued)

FOREIGN PATENT DOCUMENTS

EP 1462868 A2 * 9/2004
JP 2000-112238 A 4/2000
(Continued)

OTHER PUBLICATIONS

Matsumoto, U.S. Appl. No. 13/429,717, filed Mar. 26, 2012.
Japanese Office Action dated Jan. 19, 2016, in related Japanese Patent Application No. 2012-065896.

*Primary Examiner* — Walter L Lindsay, Jr.
*Assistant Examiner* — Philip Marcus T Fadul
(74) *Attorney, Agent, or Firm* — Fitzpatrick, Cella, Harper & Scinto

(57) ABSTRACT

A developing device includes a developer carrying member for carrying a developer; a circulation path along which the developer is circulated; a carrier supplying portion; a discharge opening, provided in the circulation path, through which a portion of the developer is to be overflowed and discharged; and a feeding member comprising a rotation shaft and a blade portion including a helical portion. An outer diameter of the blade portion formed in a first region including at least a portion opposing the discharge opening is smaller than that in a second region adjacent to the first region with respect to a rotation shaft direction. A smaller average angle formed between the rotation shaft and a developer feeding surface of the blade portion in the first region is smaller than that in the second region.

13 Claims, 20 Drawing Sheets

(56) References Cited

U.S. PATENT DOCUMENTS

| | | | | |
|---|---|---|---|---|
| 2011/0026975 | A1* | 2/2011 | Okuda | 399/263 |
| 2011/0158700 | A1* | 6/2011 | Iwata | G03G 15/0877 399/254 |
| 2011/0236074 | A1* | 9/2011 | Maeda et al. | 399/254 |

FOREIGN PATENT DOCUMENTS

| | | | |
|---|---|---|---|
| JP | 2004-206088 | A | 7/2004 |
| JP | 2006-215331 | A | 8/2006 |
| JP | 2007-264511 | A | 10/2007 |
| JP | 2009-237223 | A | 10/2009 |

* cited by examiner (a) EMB. 1

(b) COMP. EMB. 3

DEVELOPING DEVICE HAVING ROTATING FEEDING MEMBER

FIELD OF THE INVENTION AND RELATED ART

The present invention relates to a developing device provided with a discharge opening through which a developer is to be overflowed, in a side wall of a circulation path of the developer. Specifically, the present invention relates to the developing device capable of suppressing excessive discharge of the developer through the discharge opening even when flowability of the developer is lowered.

An image forming apparatus in which an electrostatic image formed on an image bearing member is developed into a toner image with the develop containing a toner and a carrier and then the toner image is, after being transferred into the recording material, fixed on the recording material under application of heat and pressure has been widely used. The developing device triboelectrically charges the toner and the carrier in the circulation path in a developing container by rotating a screw member to feed the developer under stirring.

The developer containing the toner and the carrier is gradually lowered in charging performance of the carrier by continuous circulation of carrier, which is not consumed by image formation, while being subjected to friction in the developing container. For this reason, while supply a fresh carrier to the developing container, a part of the fed developer is overflowed and discharged through a discharge opening provided in the circulation path, so that an average charging performance of the carrier in the developer is ensured (Japanese Laid-Open Patent Application (JP-A) 2007-264511).

JP-A 2007-264511 discloses that flowability of the developer in the circulation path is changed with a change in temperature and humidity or a change in toner consumption (change in image density), with the result that an amount of the developer overflowed through the discharge opening is changed and thus the developer amount in the developing container is not stabilized. Further, in order to solve this problem, at a region upstream of and adjacent to a region of a screw member along the discharge opening with respect to a developer feeding direction, a feeding performance of the screw member is lowered more than that at its downstream region.

However, in recent years, as a result of an increased speed of rotation of the screw member while a volume of the developer filled in the developing container is decreased with downsizing of the developing device, the developer discharged through the discharge opening with the rotation of a helical blade in the region along the discharge opening is increased. Further, the discharged amount is influenced by the flowability of the developer and therefore even in the constitution of JP-A 2007-264511, the developer amount in the developing container has been unable to be stabilized sufficiently.

Therefore, as described in JP-A 2000-112238, a decrease in amount of the developer itself discharged through the discharge opening at the region of the screw member along the discharge opening by removing the helical blade or decreasing a diameter of the helical blade was proposed.

At the region of the screw member along the discharge opening, when the helical blade is removed or decreased in diameter, the discharge by the helical blade at the region of the screw member along the developing container is prevented and therefore a timewise fluctuation amount of the developer discharged through the discharge opening is decreased.

However, as pointed out in JP-A 2007-264511, when the flowability of the developer is lowered by an increase in temperature and humidity or by acceleration of a deterioration of the developer, the amount of the developer discharged through the discharge opening starts to fluctuate irregularly. Further, when the developer is discharged in a certain amount, then the developer amount in the developing container is below necessary amount for a while, so that a developing performance is lowered.

For phenomenal explanation, when the helical blade is removed or decreased in diameter, the feeding performance of the screw blade at the region along the discharge opening is lowered compared with an upstream portion with respect to the developer feeding direction. For this reason, the developer is stagnated and raised at an upstream side of the discharge opening. When the flowability of the developer is lowered, a so-called angle of repose becomes large, so that the raised developer is not readily collapsed by its own weight. For that reason, the raised developer is fed toward the downstream side along the discharge opening, thus being liable to be discharge through the discharge opening so as to be intermittently collapsed.

SUMMARY OF THE INVENTION

A principal object of the present invention is to provide a developing device having a constitution in which a blade portion at a discharge opening opposing portion is decreased in diameter, wherein raising of a developer fed along a discharge opening is suppressed and is not readily discharged unstably even when flowability of the developer is lowered.

According to an aspect of the present invention is to provide a developing device comprising: a developer carrying member for carrying a developer comprising a toner and a carrier; a circulation path along which the developer to be supplied to the developer carrying member is circulated while being stirred; carrier supplying means for supplying at least the carrier to the circulation path; a discharge opening, provided in the circulation path, through which a part of the circulated developer is to be overflowed and discharged; and a feeding member comprising a rotation shaft rotatably provided in the circulation path so as to oppose the discharge opening and a blade portion which including a portion helically formed around the rotation shaft, wherein an outer diameter of the blade portion formed in a first region including at least a portion opposing the discharge opening is smaller than that in a second region adjacent to the first region with respect to a direction of the rotation shaft, and wherein a smaller average angle formed between the rotation shaft and a developer feeding surface of the blade portion in the first region is smaller than that in the second region.

These and other objects, features and advantages of the present invention will become more apparent upon a consideration of the following description of the preferred embodiments of the present invention taken in conjunction with the accompanying drawings.

Figure 4:
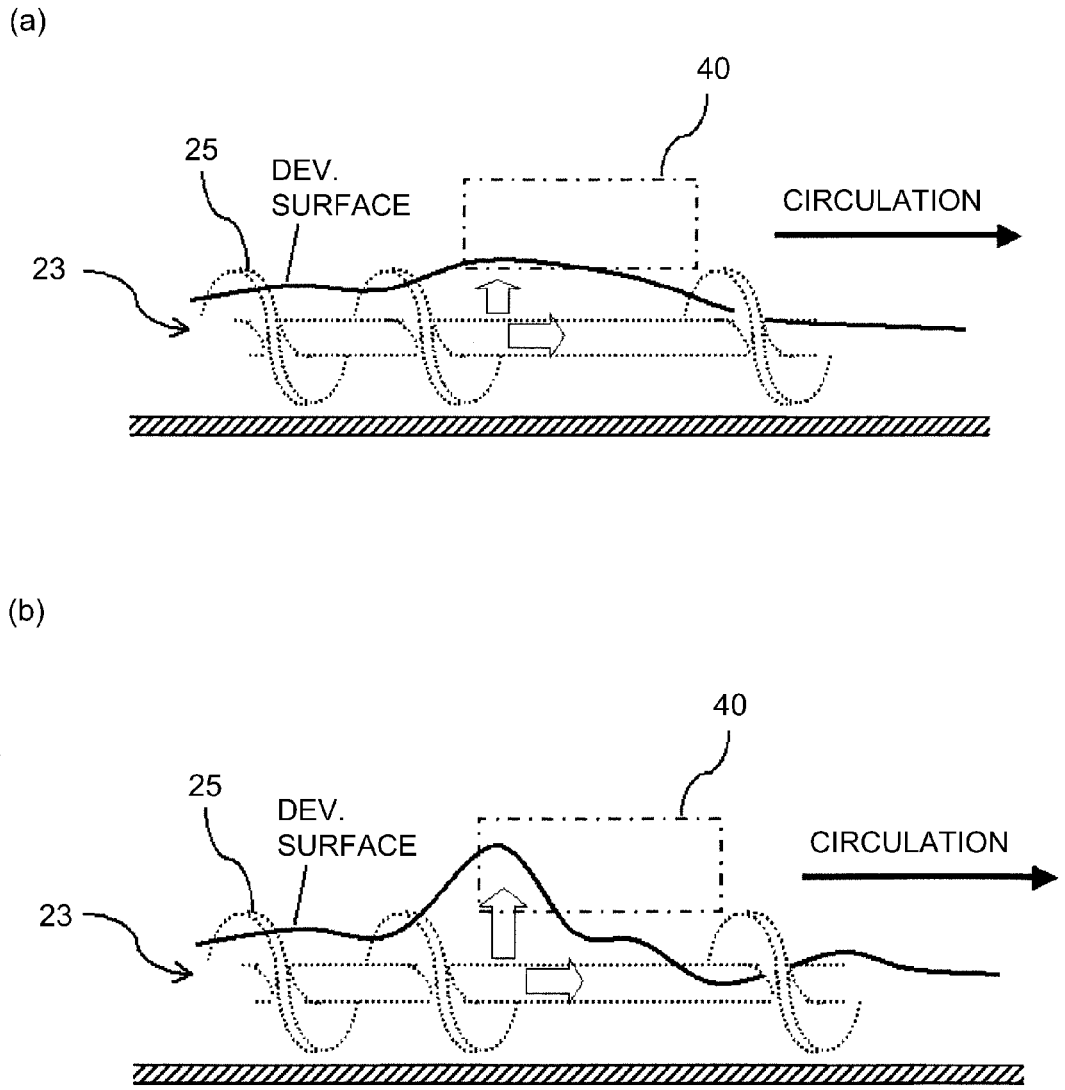

Parts (a) and (b) of FIG. 4 are illustrations of an operation of a first feeding screw in Comparative Embodiment 1 with respect to developers different in flowability.

Figure 5:
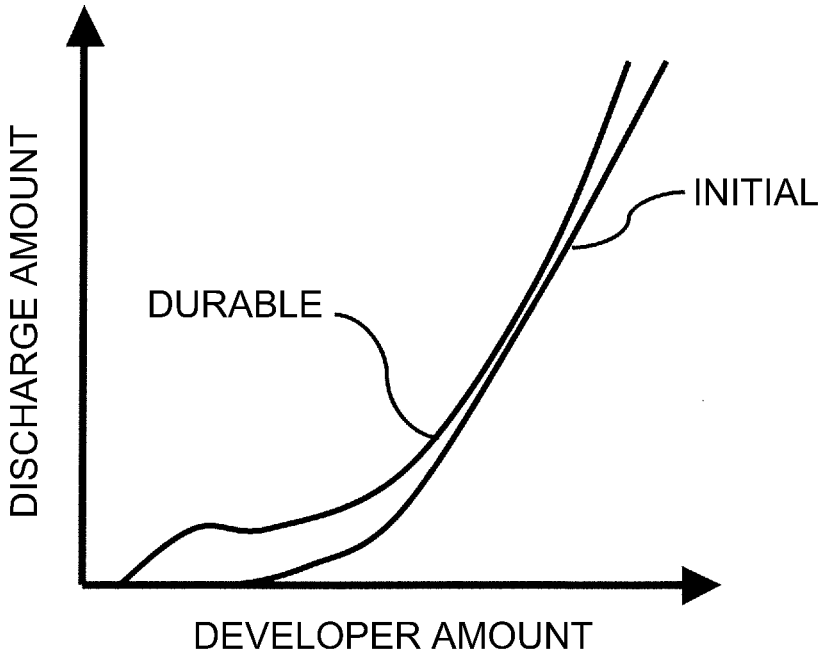

FIG. 5 is a graph showing a developer discharging characteristic in the case where the first feeding screw in Comparative Embodiment 1 is used.

Figure 6:
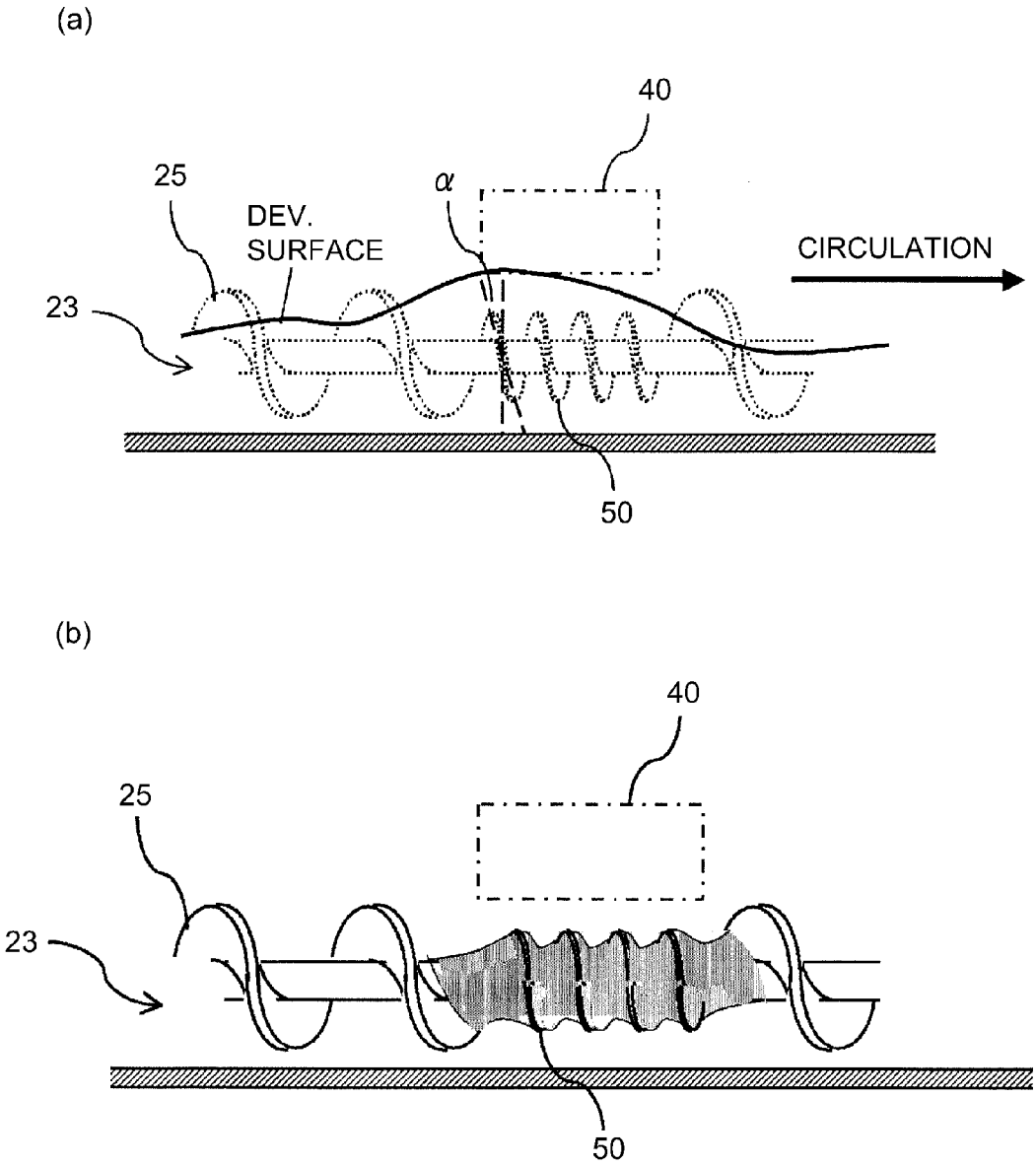

Parts (a) and (b) of FIG. 6 are illustrations of an operation of a first feeding screw in Comparative Embodiment 2 with respect to developers different in flowability.

Figure 7:
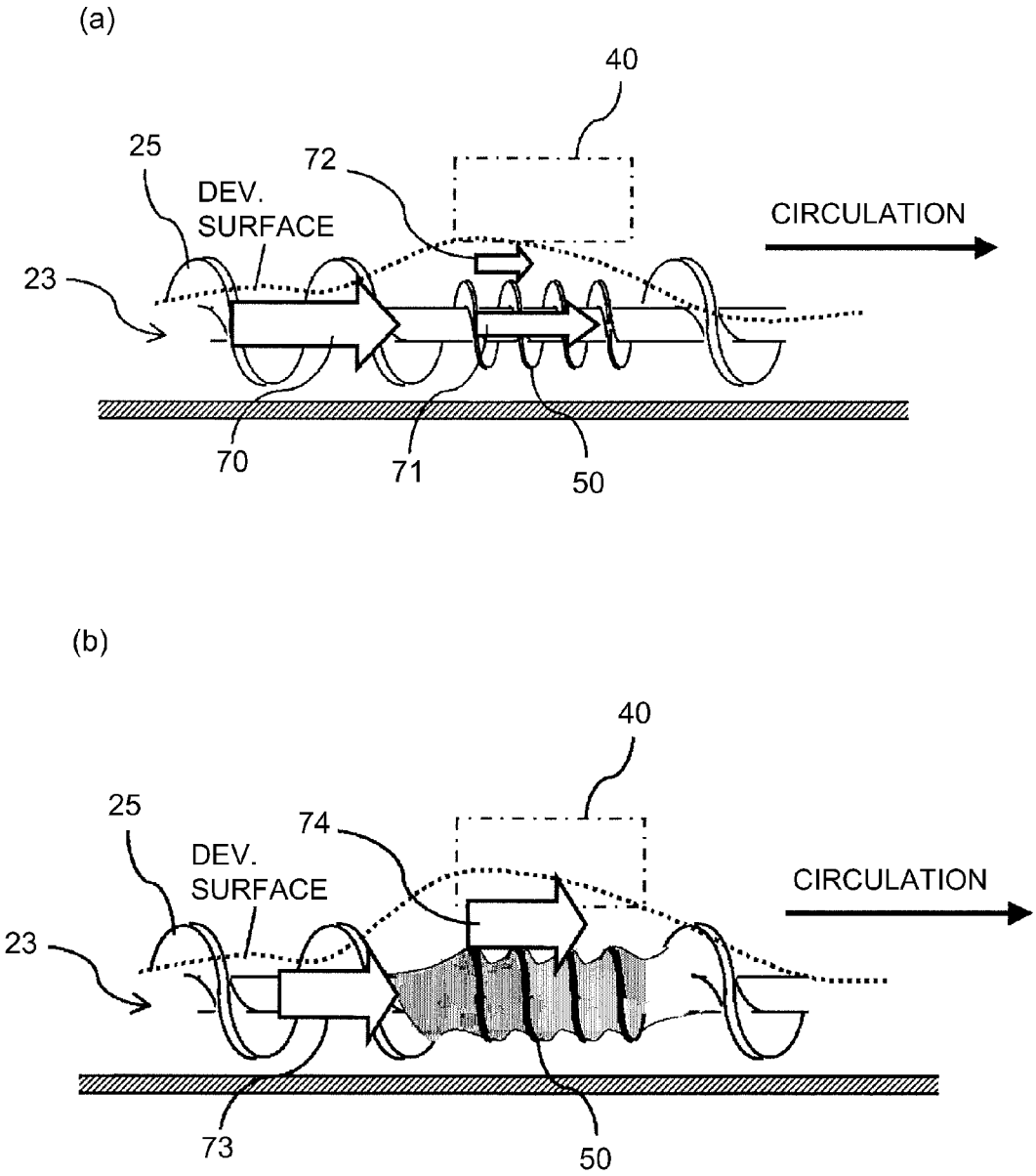

Parts (a) and (b) of FIG. 7 are illustrations of flow of the developers along the first feeding screw in Comparative Embodiment 2.

Figure 8A:
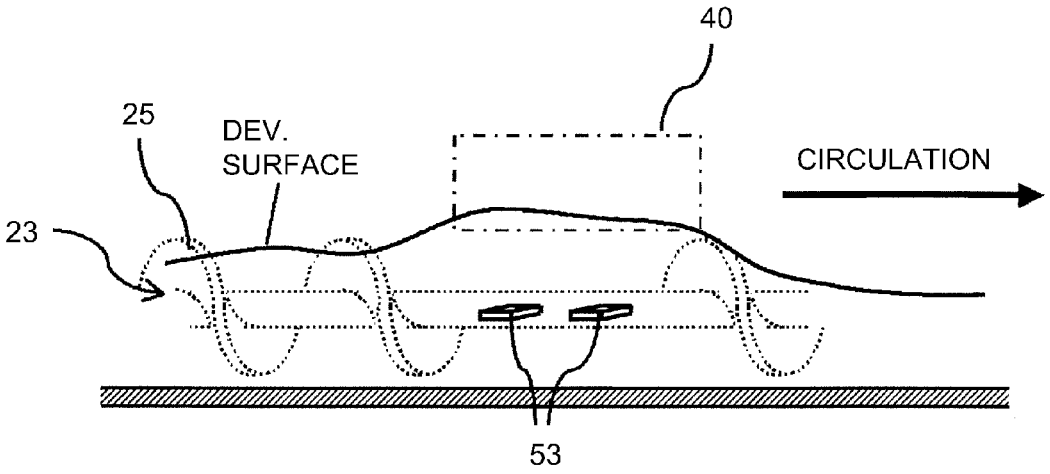
Figure 8B:
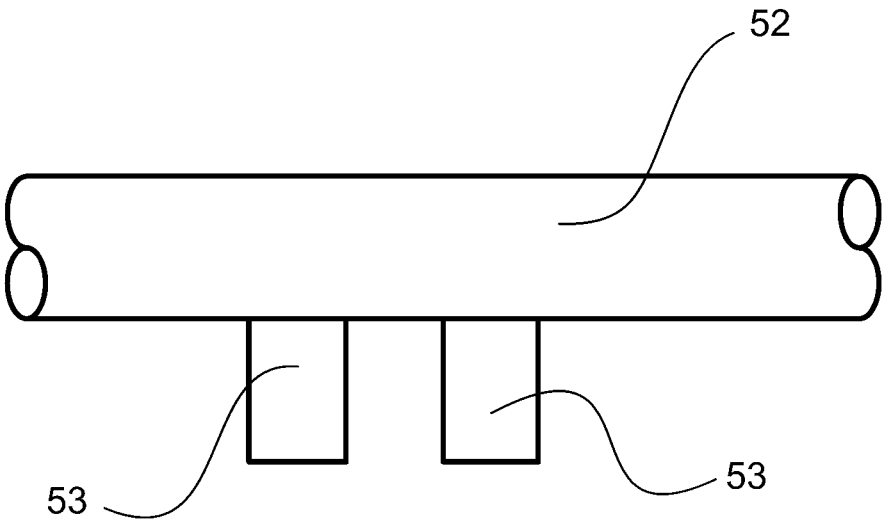
Figure 8C:
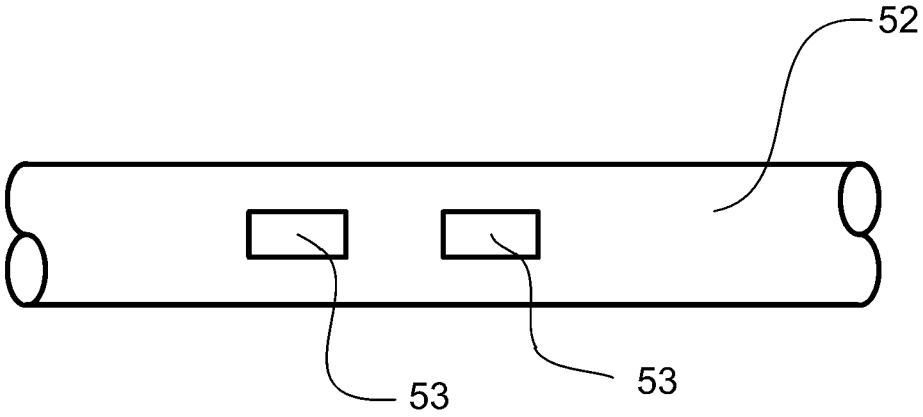

FIGS. 8A to 8C are illustrations of a first feeding screw in Embodiment 1.

Figure 9:
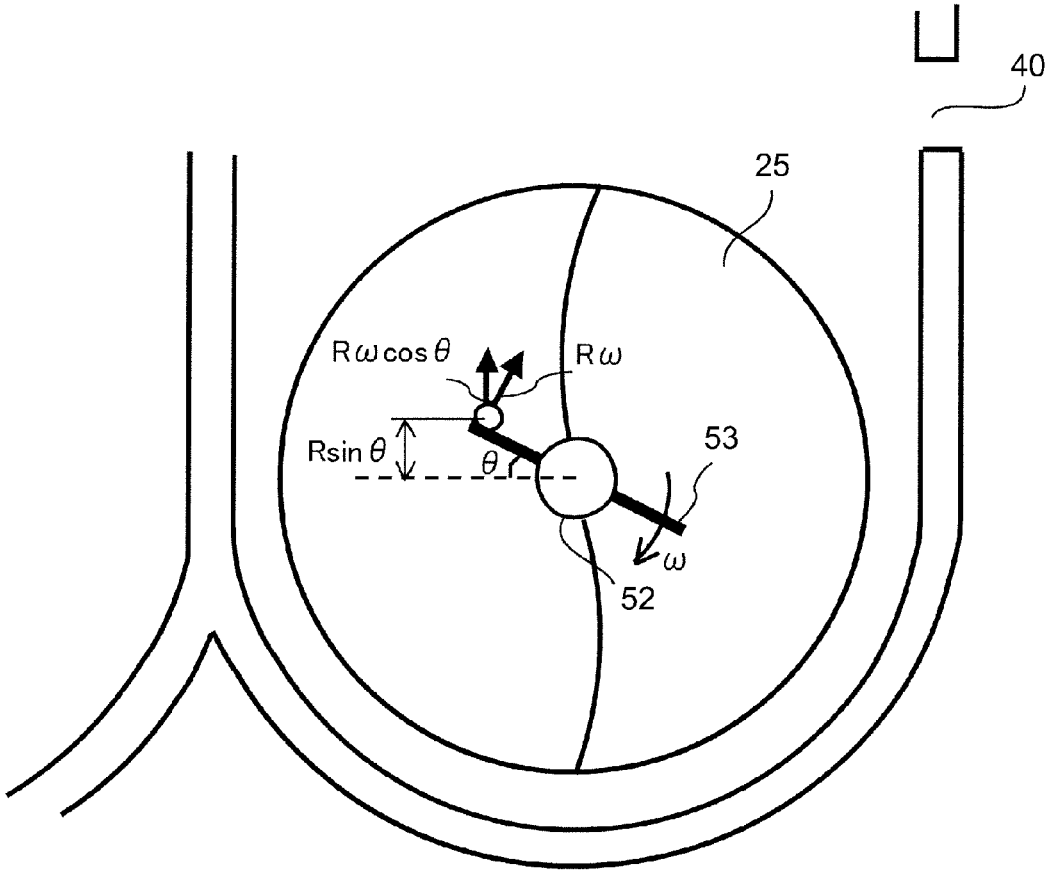

FIG. 9 is an illustration of a length of ribs.

Figure 10:
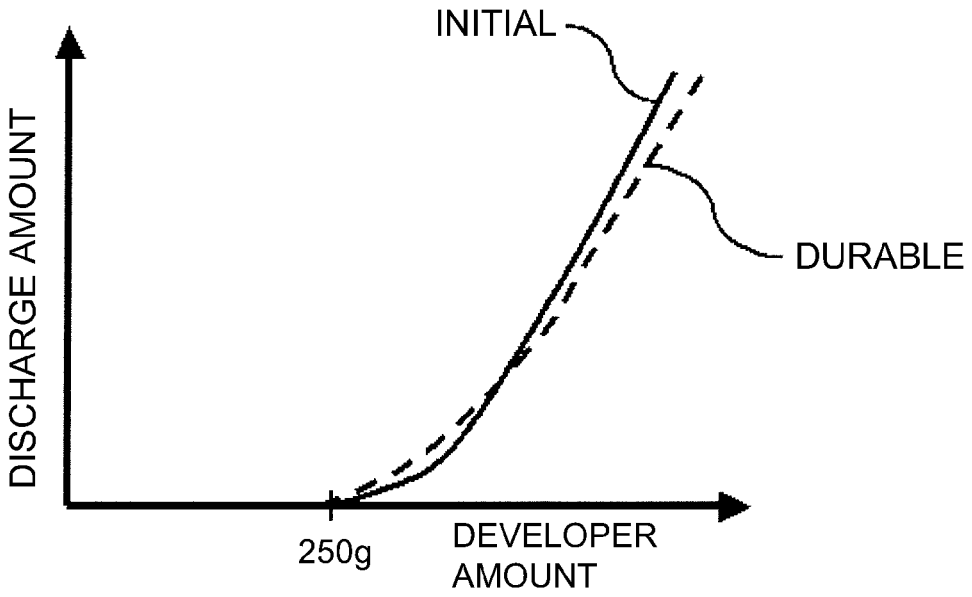
Figure 10:
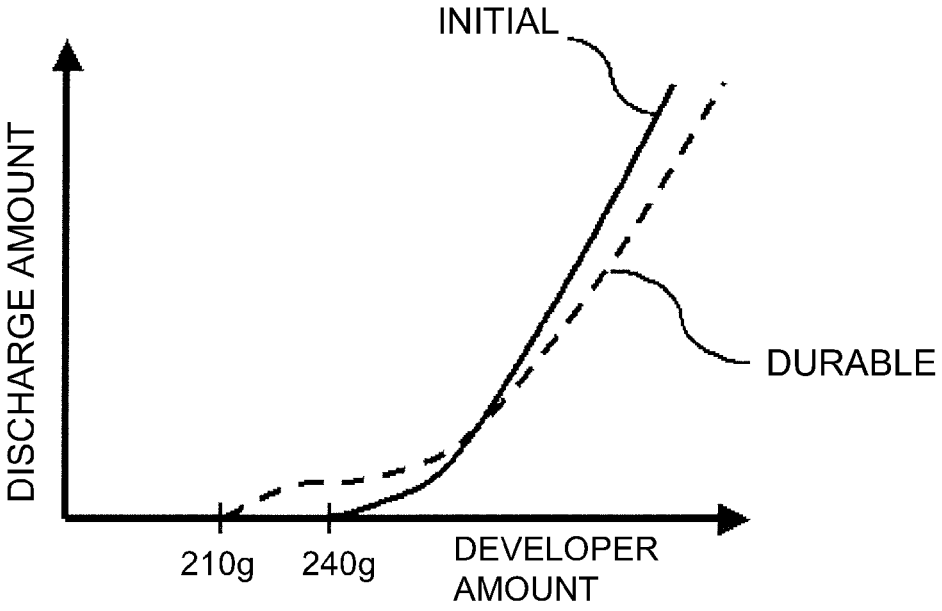

Parts (a) and (b) of FIG. 10 are graphs showing an effect of the ribs in the first feeding screw in Embodiment 1 ((a)) relative to ribs in a Comparative Embodiment 3 ((b)).

FIGS. 11A to 11D are illustrations of a structure of a first feeding screw in Embodiment 2.

Figure 12:
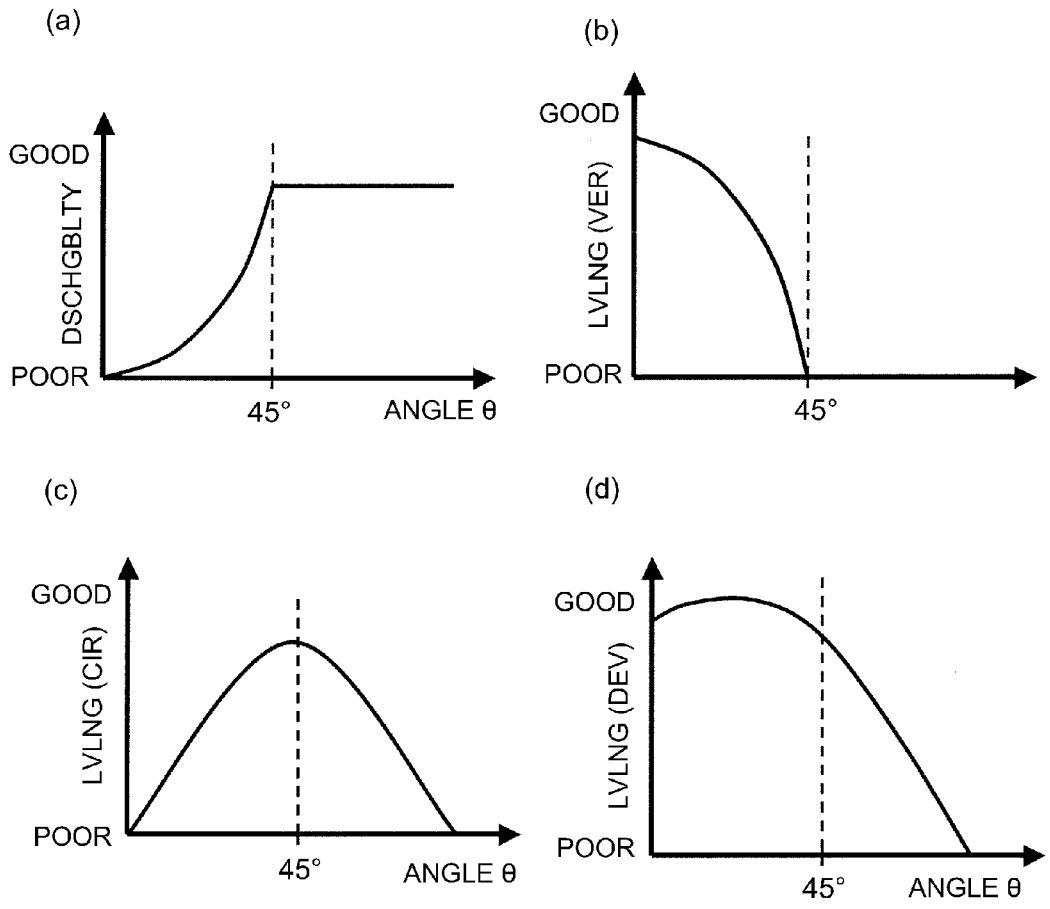

Parts (a) to (d) of FIG. 12 are graphs each showing a relationship between an inclination angle of an inclined surface of a rib and a discharging/stirring performance.

FIGS. 13A to 13E are illustrations of a structure of a first feeding screw in Embodiment 3.

Figure 14:
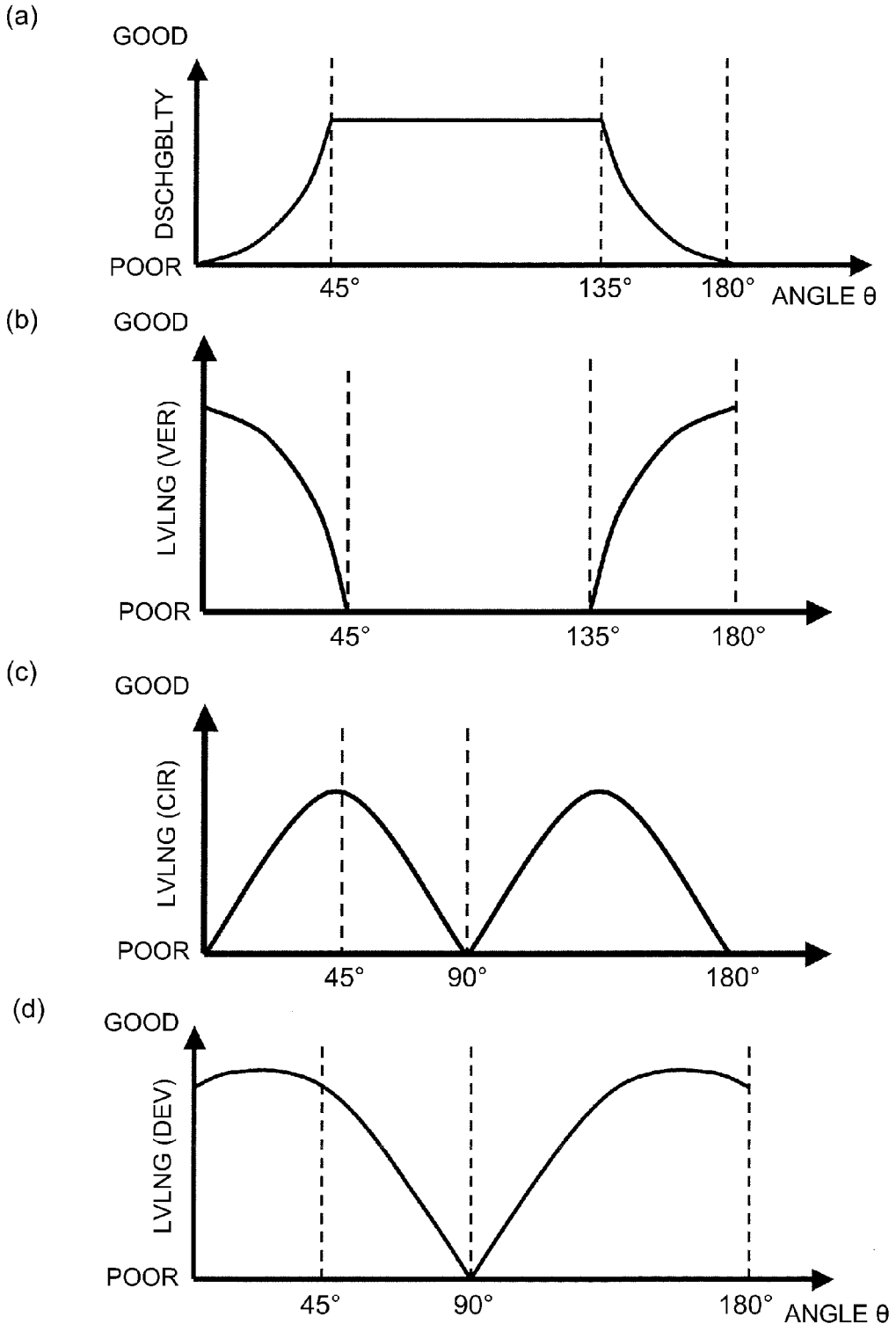

Parts (a) to (d) of FIG. 14 are graphs each showing a relationship between an inclination angle of an inclined surface of a rib and a discharging/stirring performance.

Figure 15:
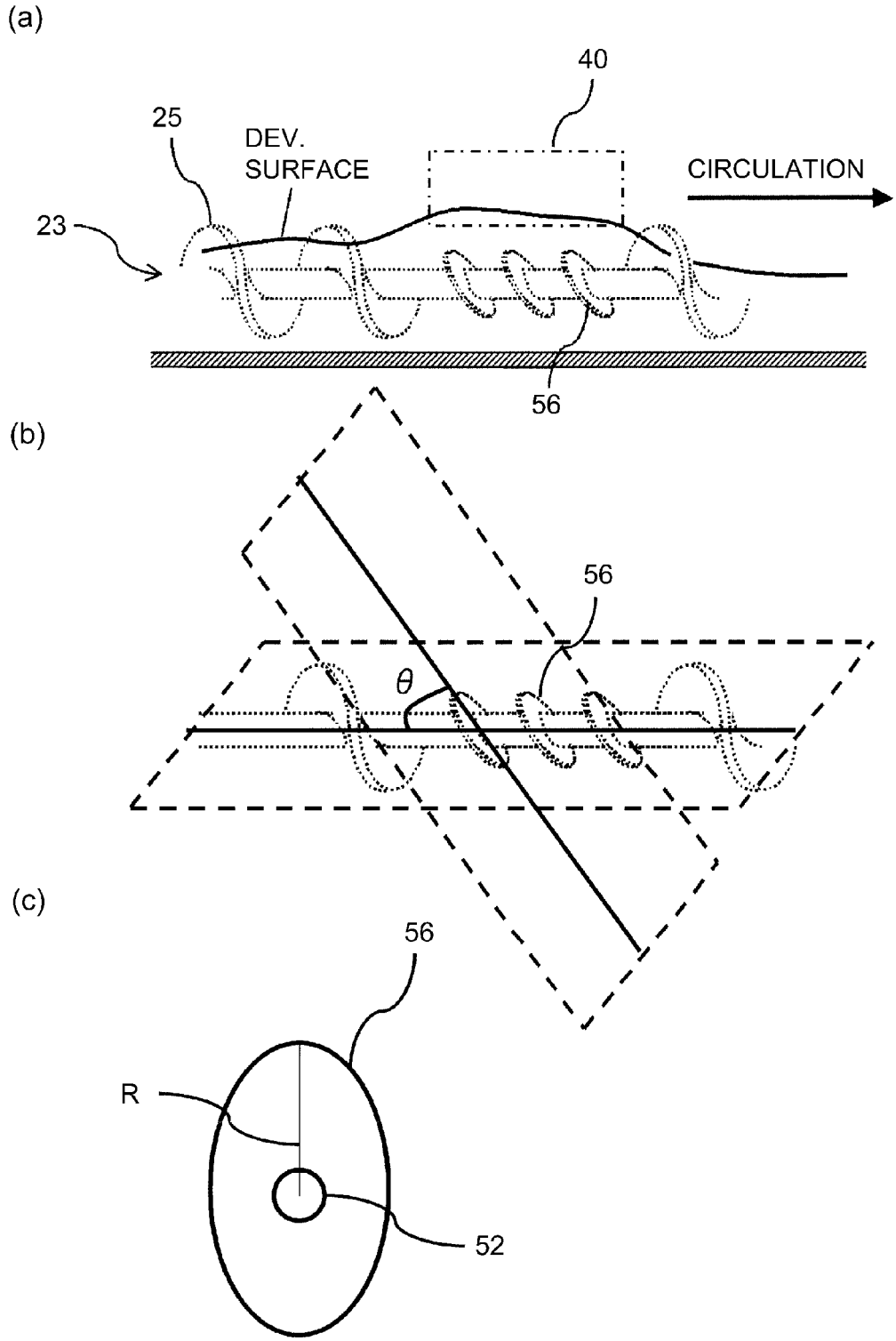

Parts (a) to (c) of FIG. 15 are illustrations of a structure of a first feeding screw in Embodiment 4.

Figure 16:
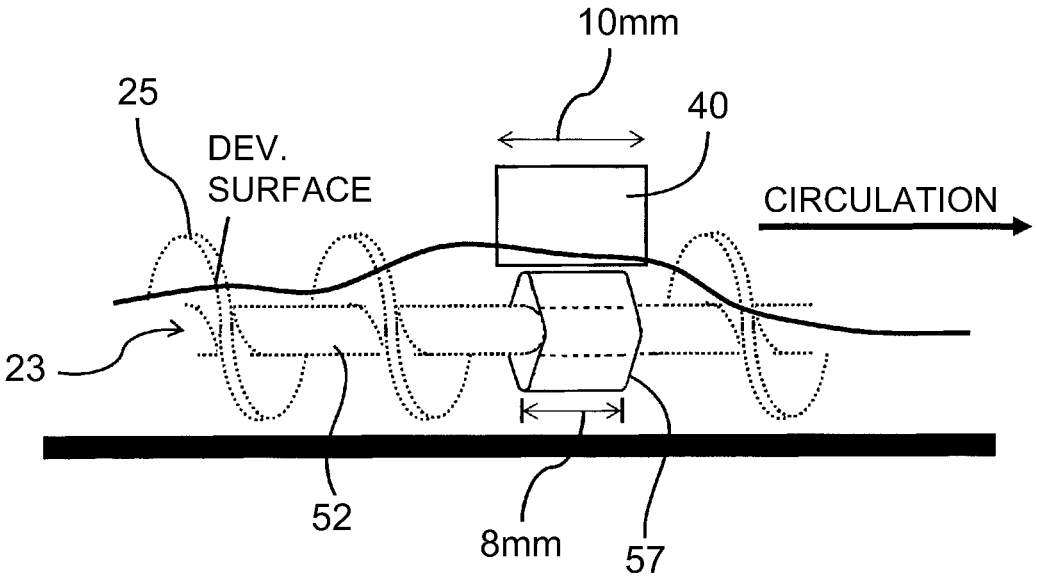
Figure 17:
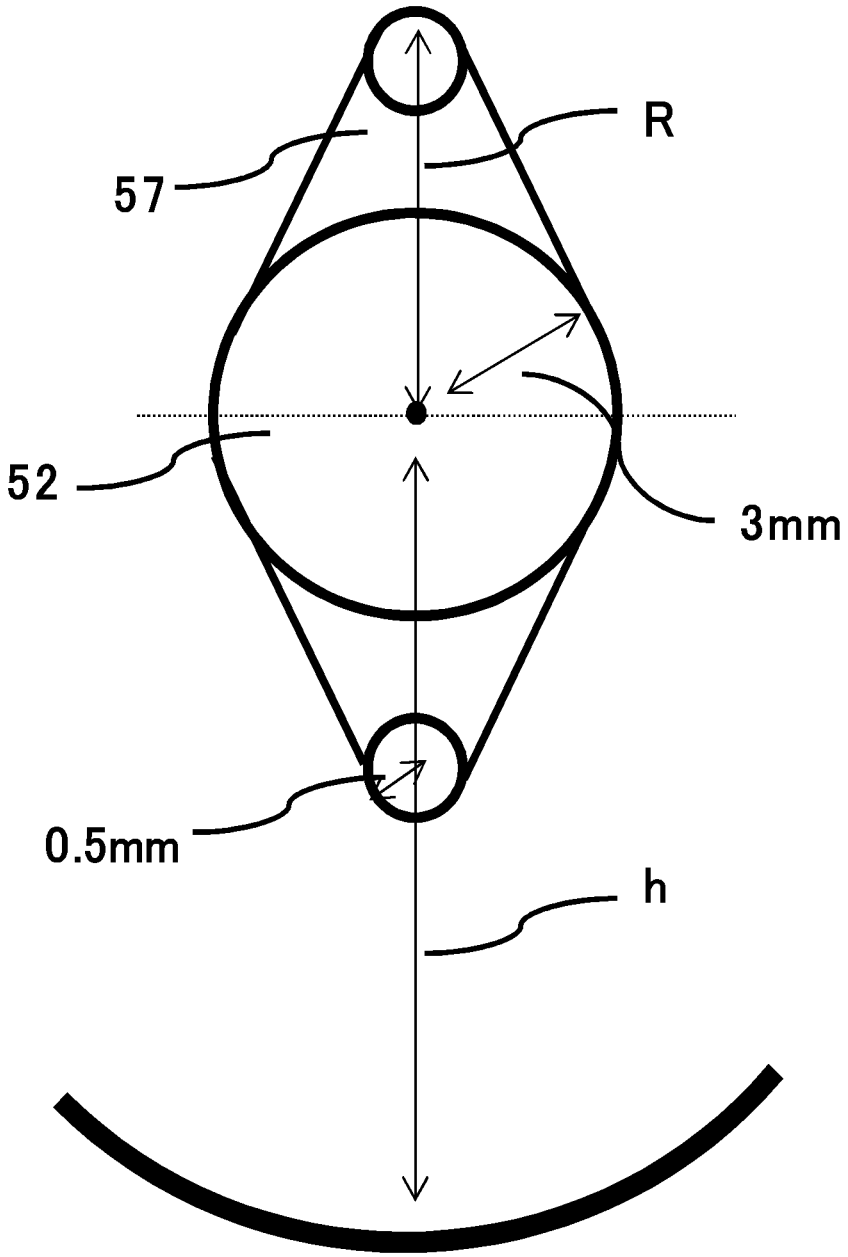

FIGS. 16 and 17 are illustrations of a leveling member for a first feeding screw in Embodiment 5.

DESCRIPTION OF THE PREFERRED EMBODIMENTS

Hereinbelow, embodiments of the present invention will be described with reference to the drawings. The present invention can also be carried out in other embodiments in which a part or all of constitutions of the following embodiments are replaced with alternative constitutions so long as stirring with a rib is performed in place of feeding with a helical blade in a region of a screw member along a developer discharge opening.

Therefore, when a developing device uses a two-component developer, the present invention can be carried out in not only the developing device of a horizontal type in which a developing chamber and a stirring chamber are horizontally arranged but also in the developing device of a vertical type in which the developing chamber and the stirring chamber are vertically arranged. Further, the present invention can also be carried out in not only the developing device using a single developer carrying member but also developing devices using two and three developer carrying members.

The present invention can be carried out irrespective of a difference between a tandem type and a one-drum type, a difference among an intermediary transfer type, a recording material conveying type and a direct transfer type and a difference between a monochromatic image forming apparatus and a full-color image forming apparatus. In the following embodiments, only a major part of the image forming apparatus relating to formation and transfer of the toner image will be described but the present invention can be carried out in various fields of apparatuses or machines such as printers various printing machines, copying machines, facsimile machines, and multi-function machines.

<Image Forming Apparatus>

Figure 1:
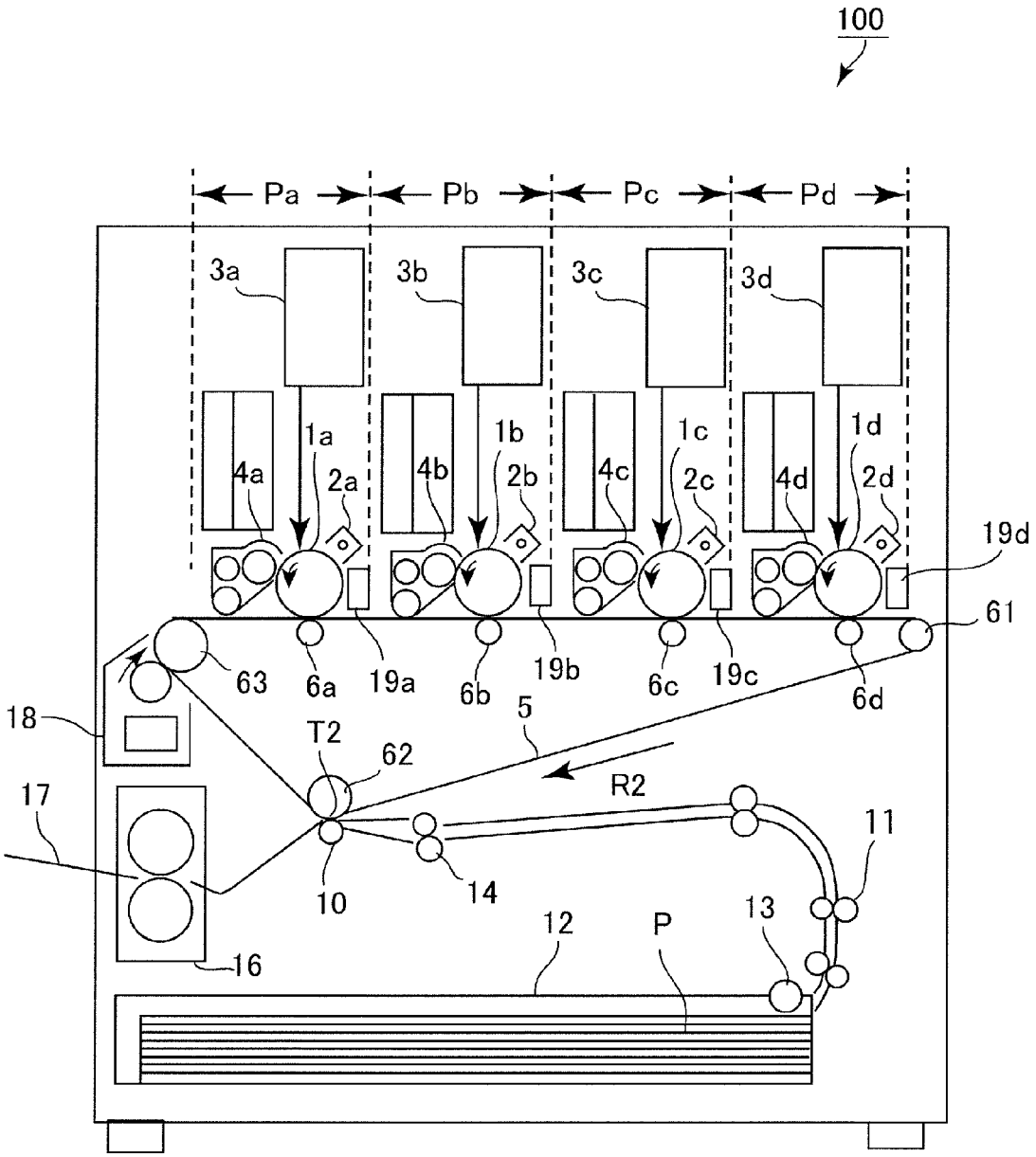
FIG. 1 is an illustration of a structure of an image forming apparatus.

FIG. 1 is an illustration of a structure of an image forming apparatus 100. As shown in FIG. 1, the image forming apparatus 100 is an intermediary transfer type full-color printer of the tandem type in which image forming portions Pa for yellow, Pb for magenta, Pc for cyan, and Pd for black are disposed along an intermediary transfer belt 5. In the image forming apparatus for forming a full-color or multi-color image by an electrophotographic process, from viewpoints of a coloring property and a color mixing property, most of the developing devices use the two-component developer containing a toner and a carrier in mixture.

At the image forming portion Pa, a yellow toner image is formed on a photosensitive drum 1*a* and then is primary-transferred onto the intermediary transfer belt 5. At the image forming portion Pb, a magenta toner image is formed on a photosensitive drum 1*b* and then is primary-transferred onto the intermediary transfer belt 5. At the image forming portions Pc and Pd, a cyan toner image and a black toner image are formed on a photosensitive drum 1*c* and a photosensitive drum 1*d*, respectively, and are primary-transferred onto the intermediary transfer belt 5.

The four color toner images carried on the intermediary transfer belt 5 are conveyed to a secondary transfer portion T2, at which the four color toner images are secondary-transferred onto a recording material P.

The intermediary transfer belt 5 is supported by being extended around a tension roller 61, a driving roller 63 and an opposite roller 62 and is driven by the driving roller 63, thus being rotated in the direction indicated by an arrow R2.

A secondary transfer roller 10 is contacted to the intermediary transfer belt 5 which is supported by the opposite roller 62 at an inner surface, thus forming a secondary transfer portion T2. The recording material P pulled out from a recording material cassette 12 is separated one by one by a separation roller 13 to be sent to registration rollers 14. The registration rollers 14 sends the recording material P to the secondary transfer portion T2 while timing the recording material P to the toner images on the intermediary transfer belt 5.

In a process in which the recording material P is nip-conveyed at the secondary transfer portion T2 while being superposed with the toner images, a voltage is applied to the secondary transfer roller 10, so that the full-color toner images are secondary-transferred from the intermediary transfer belt 5 onto the recording material P. Transfer residual toner remaining on the surface of the intermediary transfer belt 5 is collected by a belt cleaning device 18.

The recording material P on which the four color toner images are secondary-transferred is curvature-separated from the intermediary transfer belt 5 and is sent into a fixing device 16, in which the toner images are subjected to application of heat and pressure and thus are fixed on a surface of the recording material P. Thereafter, the recording material P is discharged on a discharge tray 17.

The image forming portions Pa, Pb, Pc and Pd have the substantially same constitution except that the colors of toners of yellow for a developing device 4*a* provided at the image forming portion Pa, of magenta for a developing device 4*b* provided at the image forming portion Pb, of cyan for a developing device 4*c* provided at the image forming portion Pc, and of black for a developing device 4*d* provided at the image forming portion Pd are different from each other. In the following description, the image forming portion Pa will be described and with respect to other image forming portions Pb, Pc and Pd, the suffix a of reference numerals (symbols) for representing constituent members (means) for the image forming portion Pa is to be read as b, c and d, respectively, for explanation of associated ones of the constituent members for the image forming portions Pb, Pc and Pd.

At the image forming portion Pa, around the photosensitive drum 1*a*, a corona charger 2*a*, an exposure device 3*a*, the developing device 4*a*, a primary transfer roller 6*a* and a drum cleaning device 7*a* are disposed. The photosensitive drum 1*a* is constituted by forming a negatively chargeable photosensitive layer on a substrate of an aluminum cylinder and is rotated in a direction indicated by an arrow R1.

The surface of the photosensitive drum 1*a* is irradiated with charged particles accompanying corona discharge by the corona charger 2*a*, so that the surface of the photosensitive drum 1*a* is electrically charged uniformly to a negative-polarity dark portion potential VD. The exposure device 3*a* writes (forms) a latent image for an image on the charged surface of the photosensitive drum 1*a* by scanning of the charged surface through a rotation mirror with a laser beam obtained by ON-OFF modulation of scanning line image data expanded from a separated color image for yellow. The surface potential of the photosensitive drum 1*a* charged to a dark portion potential is lowered to a light portion potential VL by being subjected to the exposure, so that the negatively charged toner can be deposited on the photosensitive drum 1*a*.

The developing device 4*a* develops the electrostatic image formed on the photosensitive drum 1*a* to form the toner image as described later.

The primary transfer roller 6*a* urges the inner surface of the intermediary transfer belt 5 to form a primary transfer portion between the photosensitive drum 1*a* and the intermediary transfer belt 5. By applying a voltage to the primary transfer roller 6*a*, the toner image carried on the photosensitive drum 1*a* is primary-transferred onto the intermediary transfer belt 5.

The drum cleaning device 7*a* rubs the photosensitive drum 1*a* with a cleaning blade to collect transfer residual toner remaining on the photosensitive drum 1*a* without being primary-transferred onto the intermediary transfer belt 5.

<Developing Device>

Figure 2:
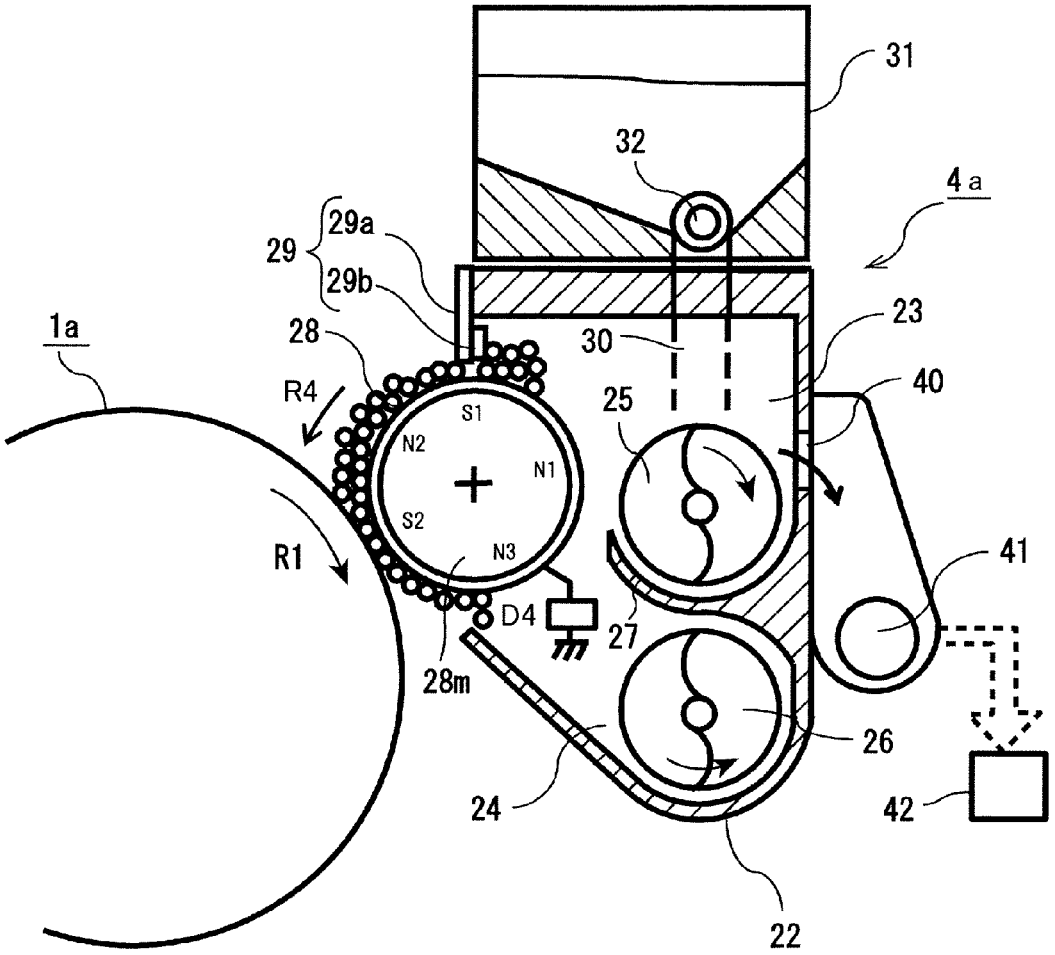
FIG. 2 is an illustration of a structure of a developing device.
Figure 3:
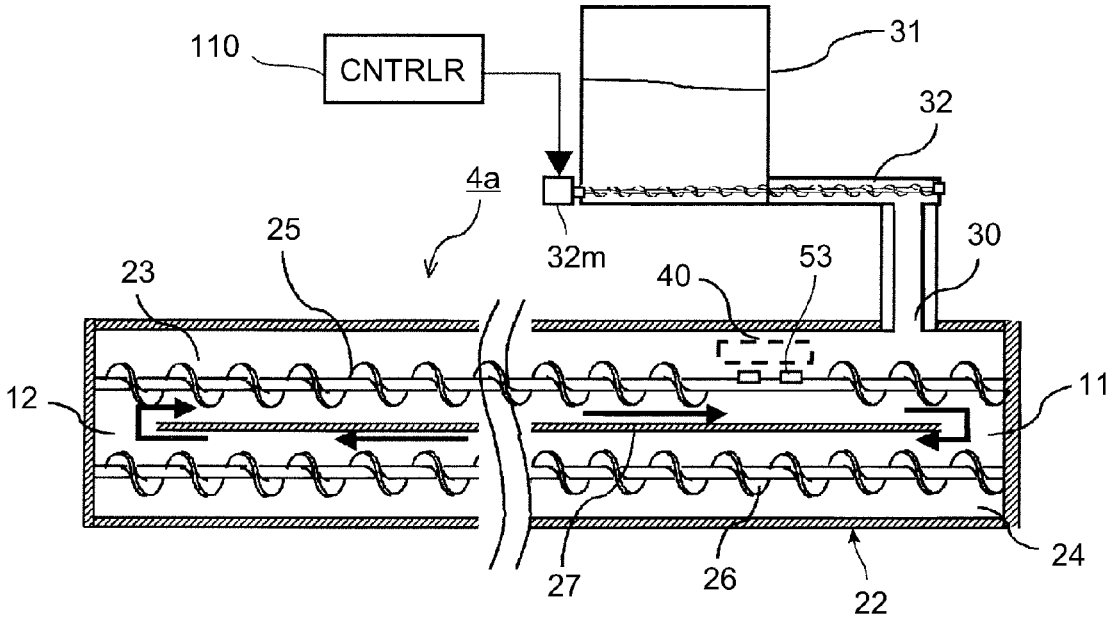
FIG. 3 is an illustration of a circulation path of a developer in the developing device.

FIG. 2 is an illustration of a structure of the developing device. FIG. 3 is a plan view of the developing device.

As shown in FIG. 2, a developing chamber 23 as an example of a circulation path circulates the developer supplied to a developing sleeve 28 while stirring the developer. With rotation of a first feeding screw 25 as an example of a screw member, the developer in the developing chamber 23 is fed in one direction. The developing sleeve 28 as an example of a developer carrying member carries the developer containing the toner and the carrier.

The developing device 4*a* accommodates, as the developer, the two-component developer containing the toner and the carrier in a developing container 22.

An opening of the developing container 22 is provided at a position where the developing sleeve 28 opposes the photosensitive drum 1*a*, and the developing sleeve 28 is disposed rotatably at the opening so as to be partly exposed toward the photosensitive drum 1*a*. The developing container 22 includes the developing sleeve 28 and a chain cutting member 29 for regulating the developer carried on the developing sleeve 28. The photosensitive member 1*a* is rotated at a peripheral speed of 850 rpm and has a diameter of 30 mm. The developing sleeve 28 is rotated at the peripheral speed of 500 rpm and has the diameter of 20 mm.

The developing sleeve 28 carries the two-component developer regulated in layer thickness by cutting the chain of the developer by the chain cutting member 29, and feeds the developer to a developing region where the developing sleeve 28 opposes the photosensitive member 1*a*, thus supplying the developer to the electrostatic image formed on the photosensitive member 1*a* to develop the electrostatic image into a toner image. The developing sleeve 28 is constituted by a non-magnetic material such as aluminum or stainless steel and inside the developing sleeve 28, a magnet roller 28*m* is provided non-rotatably. The developing sleeve 28 carries the two-component developer in a magnetic brush state during the image formation and rotates in an arrow R4 direction (counterclockwise direction), thus feeding the developer to the opposing region to the photosensitive member 1*a*. The distance of the closest region between the developing sleeve 28 and the photosensitive member 1*a* is set at about 40 μm so that the development can be made in a state in which the magnetic brush of the developer fed to the opposing region is contacted to the photosensitive member 1*a*.

The chain cutting member 29 regulates the layer thickness of the developer, carried on the developing sleeve 28, by the cutting of the magnetic brush. The chain cutting member 29 is constituted by a plate-like non-magnetic member 29*a* formed of aluminum or the like extended along a longitudinal direction of the developing sleeve 28, and a magnetic member 29*b* of an iron material or the like. By adjusting the gap between the chain cutting member 29 and the developing sleeve 28, an angle of the developer fed to the developing region on the photosensitive member 1*a* is adjusted. In this case, by the chain cutting member 29, an angle of coating of the developer per unit area on the developing sleeve 28 is adjusted at 30 mg/cm$^2$. The gap between the chain cutting member (regulating blade) 29 and the developing sleeve 28 is set at 200-1000 μm, preferably 300-700 μm. In this case, the gap was set at 400 μm.

A power source D3 applies to the developing sleeve 28 a developing voltage in the form of a DC voltage Vdc biased with an AC voltage, so that the toner deposited electrostatically on the carrier constrained by the developing sleeve 28 by a magnetic force of the magnet roller 28*m* is transferred onto the electrostatic image on the photosensitive member 1*a*.

The inside of the developing container 22 is partitioned into an upper developing chamber 23 and a lower stirring chamber 24 by a shelf-like partition wall 27, at a substantially central portion with respect to a height direction, extending in a direction perpendicular to the drawing sheet surface, so that the developer is accommodated in the developing chamber 23 and the stirring chamber 24. As a developer stirring and feeding means, the first feeding screw 25 is provided in the developing chamber 23 and a second feeding screw 26 is provided in the stirring chamber 24.

The first feeding screw 25 is disposed substantially in parallel to the axial direction of the developing sleeve 28 and is rotated in an indicated arrow direction (clockwise) direction to feeding the developer in the developing chamber 23 in one direction along the axial direction. The reason why the first feeding screw 25 is rotated in the clockwise direction is that it is advantageous from the viewpoint of the supply of the developer to the developing sleeve 28.

The second feeding screw 26 is disposed substantially in parallel to the first feeding screw 25 and is rotated in a direction (counterclockwise) direction opposite to the rotational direction of the first feeding screw 25 to feed the developer in the stirring chamber 24 in a direction opposite to the feeding direction of the first feeding screw 25.

As shown in FIG. 3, via openings 11 and 12 provided at end portions of the partition wall 27, the developing chamber 23 and the stirring chamber 24 vertically communicate with each other to form a circulation path of the developer. The developer in the developing chamber 23 is fed in the arrow direction while being stirred by the first feeding screw 25 and is delivered to the stirring chamber 24 via the opening 11. The developer in the stirring chamber 24 is fed in the arrow direction while being stirred by the second feeding screw 26 and is delivered to the developing chamber 23 via the opening 12. By the feeding of the developer through the rotations of the first feeding screw 25 and the second feeding screw 26, the developer is circulated between the developing chamber 23 and the stirring chamber 24 via the openings (i.e., communication portions) 11 and 12 at the end portions of the partition wall 27.

The first feeding screw 25 is uniformly provided with a screw blade as a stirring blade of 40 mm in pitch and 18 mm in outer diameter over the axial direction of a rotation shaft 52 of 4 mm in shaft diameter and is rotated at the peripheral speed of 800 rpm. The second feeding screw 26 has the same constitution as that of the first feeding screw 25.

Incidentally, in this embodiment, the vertical type developing device 4*a* in which the developing chamber 23 and the stirring chamber 24 are vertically disposed is described but the present invention can also be carried out in a horizontal type developing device in which a developing chamber and a stirring chamber are horizontally disposed and provided with feeding screws, respectively. The present invention can further be carried out in a developing device having an intermediate type between the vertical type and the horizontal type.

<Developer>

The developer circulated in the developing container 22 is the two component developer containing the toner and the carrier and contains the toner of 8% in weight ratio (T/D ratio). The toner contains a binder resin, a colorant, and, as needed, colored particles containing another additive-containing colored resin particles and an external additive such as colloidal silica fine powder externally added to the colored resin particles. The toner is a negatively chargeable polyester-based resin and may preferably have a volume-average particle size of 4 μm or more and 10 μm or less, preferably be 8 μm or less.

As the carrier, it is possible to suitable use, e.g., surface-oxidized or un-oxidized metals such as iron, nickel, cobalt, manganese, chromium, rare-earth elements; alloys of these metals; and oxide ferrite. A manufacturing method of these magnetic particles is not particularly limited. The carrier may have a weight-average particle size of 20-60 μm, preferably 30-50 μm and may have a resistivity of $10^7$ Ωcm or more, preferably $10^8$ Ωcm or more. In this embodiment, the carrier having the resistivity of $10^8$ Ωcm or more was used.

<Developer Supply Portion>

In a developing method using the two-component developer, the electric charge is imparted to the toner by the triboelectric charge between the carrier and the toner, and the toner to which the electric charge is imparted is electrostatically deposited on the latent image to form the toner image. In the two-component developing method, in order to provide an image which satisfies high durability and high stability, it is important that a stable toner charge amount is imparted to the toner. For that purpose, there is a need to realize a stable charge imparting performance of the carrier for a long term.

However, in actuality, the toner is gradually consumed by a developing operation in real time and on the other hand, the carrier remains in the developing device and therefore is continuously stirred with cumulation of the image formation and thus is contaminated by deposition of the toner or the external additive. As a result, the charging performance of the carrier is lowered and therefore the toner charge amount is lowered, so that toner scattering, image defect due to white background fog, and the like occur.

As shown in FIG. 2, the developing device 4*a* employs a so-called trickle developing type in which the toner and the carrier in a small amount are supplied with the image formation to suppress a lowering in charging performance of the carrier. A hopper 31 for supplying a developer for supply containing a fresh carrier in a predetermined proportion is provided, and an excessive developer in the developing device 4*a* in which the developer becomes excessive by the supply of the carrier from the hopper 31 is discharged through a developer discharge opening 40 provided in the side wall of the developing chamber 23, thus being collected.

In the developing device 4*a*, the supply of the fresh carrier and the discharge of a part of the circulated developer are repeated in real time, so that the deteriorated carrier in the developing device 4*a* is replaced with the newly supplied carrier little by little. As a result, a developing characteristic of the developer in the developing device 4*a* is kept at a certain level and a charging characteristic between the toner and the carrier is also kept at a certain level, so that it becomes possible to prevent a lowering in image quality of an output image.

As shown in FIG. 3, at an upper portion of the developing device 4*a*, the hopper 31 for accommodating the developer for supply in which the toner and the carrier are mixed is provided. The hopper 31 is provided with a screw-like feeding member 32 at its lower portion, and one end of the feeding member 32 extends to a position of a developer supply opening 30 provided at a front end portion of the developing device 4*a*. The toner in an amount corresponding to the toner consumption by the image formation is supplied from the hopper 31 to pass through the developer supply opening by a rotational force of the feeding member 32 and the gravitation, thus being supplied into the developing container 22.

The amount of the supply developer supplied from the hopper 31 to the developing device 4*a* is controlled by the number of turns (rotation) of the supplying screw (feeding member) 32. A controller 110 controls the number of turns of the supplying screw 32 on the basis of a detection result of a toner content (concentration), of the developer in the developing container 22, which is magnetically detected, and a detection result of reflection light detected by development of a color (toner) patch formed on the photosensitive member 1*a*. As a method of the toner supply amount control, other than the above method, there have been known various methods and therefore it is possible to select an appropriate method.

As shown in FIG. 2, the developer discharge opening 40 is provided at the wall surface of the developing chamber 23 in the developing device 4*a*, and when the developer for supply is supplied from the hopper 31 and the amount of the developer in the developing container 22 is increased, the excessive developer is discharged through the developer discharge opening 40 so as to overflow through the developer discharge opening 40. The developer overflows through the developer discharge opening 40 in an amount corresponding to the increased amount of the developer in the developing container 22. The discharged developer is conveyed to a collected developer storing portion 42 by a collecting screw 41. As shown in FIG. 3, the developer discharge opening 40 is formed upstream of the developer supply opening 30 with respect to the developer feeding direction. This is because the fresh developer supplied through the developer supply opening 30 is prevented from being immediately discharged through the developer discharge opening 40.

Incidentally, referring to FIG. 3, the developing device disclosed in JP-A 2007-264511 is provided with a screw blade also in a region of the first feeding screw 25 along the developer discharge opening 40 similarly as in the case of another portion. In this constitution, there arose a problem such that even a necessary developer which is not the excessive developer is discharged through the developer discharge opening 40 by raising of the developer by the screw blade provided opposed to the developer discharge opening 40 in the developing container 22.

The discharge amount of the developer overflowing through the developer discharge opening 40 varies depending on a height position, size and shape of the developer discharge opening 40. However, in actual discharge of the developer through the developer discharge opening 40, in addition to the excessive developer which overflows and is discharged statically, dynamic raising by the screw blade of the first feeding screw 25 opposing the developer discharge opening 40 occurs. For this reason, even in a state in which the developer surface is considerably lower than the height position of the developer discharge opening 40, the developer is forcedly discharged through the developer discharge opening 40. This phenomenon becomes more conspicuous with a higher rotational speed of the first feeding screw 25 and with a large portion where the developer surface is lowered and the first feeding screw 25 is exposed from the developer surface.

For this reason, in the developing device 4*a*, by omitting the screw blade, a force acting on the developer in a circumferential direction or an outward radial direction by the rotation of the screw blade opposing the developer discharge opening 40 becomes smaller than that in another region. For this reason, the raising discharge by the screw blade for the developer is eliminated, so that the developer discharge amount resulting from the raising and discharge of the developer by the first feeding screw 25 becomes small.

Comparative Embodiment 1

Parts (a) and (b) of FIG. 4 are illustrations of an operation of a first feeding screw in Comparative Embodiment 1 with respect to developers different in flowability. FIG. 5 is a graph showing a developer discharging characteristic in the case where the first feeding screw in Comparative Embodiment 1 is used.

As shown in (a) of FIG. 4, in Comparative Embodiment 1, the screw blade of the first feeding screw 25 opposing the developer discharge opening 40 is not used. In the constitution in Comparative Embodiment 1, at the portion where there is no screw blade opposing the developer discharge opening 40, the developer does not receive the force from the screw blade. The developer at the region opposing the developer discharge opening 40 is pushed by the developer fed from the upstream side by the screw blade located upstream of the developer discharge opening 40 and is fed while raising the developer surface. Then, when the developer surface exceeds the height of the developer discharge opening 40, the raised portion of the developer is discharged by being cut through the developer discharge opening 40.

As shown in (b) of FIG. 4, when the image formation with a small amount of toner consumption is continued, the supply of the developer for supply is stagnated and therefore a relation time of the carrier and the toner in the developing container 22 is increased, so that deterioration of the developer proceeds and thus flowability is lowered. The deterioration of the developer is a phenomenon such that by collision between the toner and the developing sleeve 28 and between toner particles, a projection of the toner is broken or the external additive at the toner surface is buried in the toner surface. In the case where the developer deterioration proceeds, the external additive such as silica added to ensure the flowability of the toner is buried in the toner surface, so that a depositing force of the toner is increased and thus the flowability of the toner is lowered. The developer deterioration is liable to occur, for the reason that the developer is stirred for a long time in the developing device 4*a*, principally when an image with a small amount of toner consumption is outputted continuously for a long time.

When the flowability of the developer is lowered, the developer is raised at the side upstream of the portion where there is no screw blade with respect to the developer circulation direction, so that the developer surface at the portion opposing the developer discharge opening 40 becomes extremely non-uniform. When such a state is caused, the developer surface is locally raised at the upstream side of the developer discharge opening. Therefore, not only the developer which is just excessive but also the developer to be needed are discharged through the developer discharge opening 40.

As shown in FIG. 5, when the image formation with the small amount of the toner consumption is continued, the flowability of the developer is lowered and the developer discharging characteristic is changed from an initial state, so that the developer is discharged even in a state in which an average developer surface does not reach the developer discharge opening 40. When the developer flowability is lowered, resulting from a local increase in developer surface by accumulation of the developer at the upstream wide of the developer discharge opening 40, the developer which should not be discharged naturally is also discharged.

As a result, the developer in the developing container 22 is decreased compared with that in the initial state and thus the amount of the developer supplied to the developing sleeve 28 becomes small, so that coating on the developing sleeve 28 becomes non-uniform. When a state in which the developer is excessively discharged and the developer circulated in the developing sleeve 22 becomes insufficient is continued, such a problem that improper coating of the developer on the developing sleeve 28 is caused.

The developer discharging characteristic of the first feeding screw in Comparative Embodiment 1 depends on the developer feeding property and the developer surface height at the region opposing the developer discharge opening 40, and the developer feeding property and the developer surface height at the region opposing the developer discharge opening 40 depend on the flowability of the developer. When the flowability of the developer is lowered, a degree of the developer raising becomes large and the developer is not readily collapsed toward the downstream side. For this reason, the raised portion of the developer is fed along the developer discharge opening 40 and is collapsed and dropped through the developer discharge opening 40, so that the developer is excessively discharged in a considerable amount.

Comparative Embodiment 2

Parts (a) and (b) of FIG. 6 are illustrations of an operation of a first feeding screw in Comparative Embodiment 2 with respect to developers different in flowability. Parts (a) and (b) of FIG. 7 are illustrations of flow of the developers along the first feeding screw in Comparative Embodiment 2.

As shown in (a) of FIG. 6, in Comparative Embodiment 2, an outer diameter of a screw blade of the first feeding screw 25 opposing the developer discharge opening 40 is made smaller than that of the screw blade at another portion to provide a small-diameter screw blade 50. A force acting on the developer with respect to the circumferential direction or the outward radial direction by the rotation of the small-diameter screw blade 50 becomes smaller than that at another region and therefore similarly as in Comparative Embodiment 1, the developer is liable to be stagnated at this portion, so that the discharge amount of the developer resulting from the raising and discharge of the developer by the first feeding screw 25 becomes small.

In this case, a smaller angle formed between a feeding surface along which the developer at the above blade portion and the rotation shaft is <β>. When the feeding surface and the rotation shaft are parallel to each other, the smaller angle is zero. The angle <β> in the case where the feeding surface is a curved surface is defined as follows. That is, an average of a smaller angle β (P) formed between the axial direction and a tangential line at each point P of a line segment L1 formed by crossing between the developer feeding surface of the small-diameter screw blade 50 and a surface including the axis of the small-diameter screw blade 50 is taken as a smaller average angle <β>. A developer leveling (smoothing) effect is inversely proportional to the average angle <β>. As in Comparative Embodiment 2, in the case where the angle of the feeding surface is changed so that the average angle <β> of the small-diameter screw blade is larger than that at the adjacent region, the developer leveling effect is reduced.

Therefore, similarly as in Comparative Embodiment 1, when the developer is deteriorated and is lowered in flowability, not only the developer which is just excessive but also the developer to be needed are discharged.

On the other hand, even in the case where the small-diameter screw blade is used, when the average angle <β> at the small-diameter portion is smaller than that of the screw blade portion at the region adjacent to the small-diameter portion, it is possible to obtain the developer surface leveling effect. Incidentally, the developer surface leveling force is determined by a proportion between a feeding force of the blade portion of the feeding member with respect to the axial direction and a feeding force of the blade portion of the feeding member with respect to the circumferential direction.

Therefore, in Comparative Embodiment 2, developer surface leveling power (force) of the first feeding screw as the feeding member is defined by the average angle <β> formed by the screw feeding surface. The average angle <β> represents a proportion of a feeding force with respect to the axial direction to a feeding force with respect to the circumferential direction. With a smaller value of this proportion, the feeding force with respect to the circumferential direction becomes larger than the feeding force with respect to the axial direction. Incidentally, in the case where the average angle <β> is the same, even when an area of the feeding surface of the blade portion is made large, the developer surface leveling effect is not substantially changed. This is because a feeding force with respect to a rotational direction can be made large by increasing the feeding area of the blade portion but simultaneously the feeding force with respect to the axial direction also becomes large and therefore resultant leveling forces cancel each other.

In the constitution in Comparative Embodiment 2, by the force exerted on the developer by the screw blade of the small-diameter screw blade 50 with the small outer diameter at the region opposing the developer discharge opening 40, even in the case where the developer is deteriorated, the developer surface leveling effect can be expected to some extent. For this reason, compared with Comparative Embodiment 1, it would be considered that the developer is not raised at the upstream side of the developer discharge opening 40 and thus the developer is not readily discharged excessively through the developer discharge opening 40.

However, in order to prevent an occurrence of the discharge through the developer discharge opening 40, there is a need to decrease a vertical direction component of the force exerted from the small-diameter screw blade 50 on the developer, so that it is desirable that the outer diameter of the small-diameter screw blade 50 is made small and simultaneously a tilt angle α of the blade is also made small. When the tilt angle α of the blade is small, the pitch of the small-diameter screw blade 50 is inevitably decreased, so that a spacing between adjacent blades is also narrowed. However, when the tilt angle α is made small as described above, the feeding force (developer surface leveling force) of the small-diameter screw blade 50 with respect to the rotational direction is smaller than the feeding force (developer surface leveling force) of an adjacent large-diameter screw blade with respect to the rotational direction and therefore the developer surface leveling effect is lowered, so that the discharge of the developer through the developer discharge opening 40 occurs.

Further, as shown in (b) of FIG. 6, according to study by the present inventors, in Comparative Embodiment 2, when the flowability of the developer is lowered, the developer is liable to be deposited on the surface of the first feeding screw 25 at the region opposing the developer discharge opening 40. In the case where the outer diameter of the small-diameter screw blade 50 is small and the pitch is also small, the small-diameter screw blade 50 is buried in the developer present at the region opposing the developer discharge opening 40 and thus the developer is liable to be interposed in the screw pitch. In this state, when the developer is deteriorated to increase the depositing force, the developer is deposited on the small-diameter screw blade 50 since the developer is always contacted to the small-diameter screw blade 50, so that the feeding force is remarkably lowered.

As shown in (a) of FIG. 7, in the case where the flowability of the developer is high, at the region opposing the developer discharge opening 40, there are flows including a flow 71 of the developer fed by the small-diameter screw blade 50 and a flow 72, outside the flow 71, of the developer pushed by the developer located upstream of the developer discharge opening 40. At an initial stage, a part of the developer flowing from the upstream side into the region opposing the developer discharge opening 40 is fed by the small-diameter screw blade 50.

Thereafter, as shown in (b) of FIG. 7, when the flowability of the developer is lowered, a region between blades of the small-diameter screw blade 50 is buried in the developer and does not contribute to the feeding of the developer and therefore the flow of the developer fed by the small-diameter screw blade 50 disappears. When the feeding power of the small-diameter screw blade 50 disappears by the deposition of the developer, the developer is fed only by an outside flow 74. Almost all flow 73 of the developer fed from the upstream side of the developer discharge opening 40 becomes the flow 74 of the developer pushed by the upstream-side developer and is fed to the downstream side while raising its surface. The developer is pushed up into an upper space of the small-diameter screw blade 50 and is considerably raised, so that the developer surface at the region opposing the developer discharge opening 40 is remarkably moved upward. Then, the developer is discharged through the developer portion 40 in an amount larger than that at the initial stage and thus the amount of the developer in the developing container 22 is decreases, so that the coating of the developer on the developing sleeve 28 becomes non-uniform.

A change in developer discharging characteristic affected by the lowering in feeding force of the small-diameter screw blade 50 by the deposition of the developer is very large. In the case where the small-diameter screw blade 50 has the feeding force at the region opposing the developer discharge opening 40, when the developer surface is optimized on the basis of the developer having the high flowability, the developer discharging characteristic after the flowability is lowered is remarkably changed, so that a necessary developing performance cannot be ensured more than that in Comparative Embodiment 1.

In the following embodiments, at the region of the first feeding screw 25 opposing the developer discharge opening 40, the feeding force in the developer feeding direction is not provided and a rib 53 (54, 55, 56) for eliminating the raising of the developer surface by stirring the developer under the developer surface is provided. As described later, the rib has a diameter smaller than diameters of screws located upstream and downstream thereof. As a result, a difference in developer discharging characteristic between the initial stage and at the time of cumulation of the image formation is made small to prevent the excessive discharge of the developer through the developer discharge opening 40, so that stabilization of the amount of the developer in the developing device 4*a* is realized.

Embodiment 1

FIG. 8A is an illustration of a first feeding screw in Embodiment 1. FIG. 8B is an enlarged top view of a rib portion in FIG. 8A. FIG. 8C is an enlarged front view of the rib portion in FIG. 8A. FIG. 9 is an illustration of a length of ribs. Parts (a) and (b) of FIG. 10 are graphs showing an effect of the ribs in the first feeding screw in Embodiment 1 ((a)) relative to ribs in a Comparative Embodiment 3 ((b)).

As shown in FIG. 8A, the developer discharge opening 40 as an example of the discharge opening is provided in the side wall of the developing chamber 23 at the side upstream of the developing sleeve 28 with respect to the developer feeding direction and through which a part of the developer circulated in the developing container 22 overflows and discharges. The hopper 31 as an example of the carrier supplying means supplies the toner and the carrier to the developing chamber 23 at the side downstream of the developer discharge opening 40 with respect to the developer feeding direction. The first feeding screw 25 as an example of the screw member is provided with the helical blade at a region except for the region along the developer discharge opening 40 of the developing chamber 23. The rib 53 as an example of a leveling member is provided, apart from the helical blade, at a region along the developer discharge opening 40 where there is no helical blade of the first feeding screw 25. The rib 53 has a diameter smaller than those of angle helical blade portions. As a result, it is possible to suppress unnecessary discharge of the developer by the raising of the developer. Further, in this embodiment, the proportion of the feeding power of the rib 53 with respect to the axial direction to the feeding power of the rib 53 with respect to the rotational direction is larger than those of the angle helical blade portions. That is, the average angle <β> formed between the developer feeding surface of the blade portion and the rotation shaft is small. Specifically, a disposition angle of the rib 53 coincides with the axis, so that the average angle <β> is zero. On the other hand, the helical blade adjacent to the rib 53 in a screw for feeding the developer in the axial direction and therefore the average angle <β> is larger than zero. For this reason, at the region opposing the discharge opening, an effect of feeding the developer in the circumferential direction is increased relative to an effect of feeding the developer in the axial direction, so that the developer leveling effect is obtained. For this reason, with the rotation of the first feeding screw 25, the developer present at the region along the developer discharge opening 40 is locally stirred or vibrated by the rib 53. As a result, apparent flowability of the developer is temporarily restored, so that the raised portion of the developer surface irregularly formed at the region along the developer discharge opening 40 is quickly collapsed in the feeding direction, thus being eliminated. Incidentally, in this embodiment, a rib forming region as a small-diameter blade portion is a first region, and a region adjacent to the first region and to be compared with the first region is a second region. The second region is each of regions upstream and downstream of the first region within 5 pitches. Incidentally, in this embodiment, a ratio of the average angle <β> at the first region to the average angle <β> at the second region may preferably be 0 or more and 0.5 or less. When the ratio is within this range, a sufficient leveling effect can be obtained.

A maximum height of an end of the rib 53 through one turn (rotation) of the first feeding screw 25 is lower than a lower edge of the developer discharge opening 40 and therefore each when the flowability of the developer is lowered, the developer is not raised and discharged through the developer discharge opening 40 with the rotation of the first feeding screw 25. Incidentally, the maximum height of the rib end is not limited to that described above.

In this embodiment, the rib 53 as the leveling member for leveling the developer surface is provided on the axis of the first feeding screw 25 at the region opposing the developer discharge opening 40.

The developer present at the region opposing the developer portion 40 is vibrated by receiving an external force from the rib 53 and thereby the raised developer is relatively easily collapsed in the circulation direction. For this reason, the developer surface at the region, along the developer discharge opening 40, including the region upstream of the developer discharge opening 40 is leveled, so that even during the cumulation of the image formation, the developer discharging characteristic which is not changed from that at the initial stage is obtained.

Further, the rib 53 itself has no feeding force of the developer in the circulation direction and therefore even in the case where the flowability of the developer is lowered and thus the developer is deposited around the rib 53, the developer feeding performance at the region opposing is not changed between before and after the deposition of the developer. For that reason, different from Comparative Embodiment 2, there is no abrupt change in developer surface, so that a stable developer discharging characteristic is obtained.

At the region opposing the developer discharge opening 40, no feeding force by the first feeding screw 25 is important and preferable from the viewpoint that the abrupt change in developer discharging characteristic is prevented. The presence of the feeding force in the circulation direction means that the developer continuously receives the force in the circulation direction with the rotation of the first feeding screw 25.

In order to obtain the stable developer discharging characteristic at the developer discharge opening 40, there is a need to prevent the developer present at the region opposing the developer discharge opening 40 from being raised and discharged by the rib 53 through the developer discharge opening 40. For this reason, it is preferable that the rib 53 satisfies the following condition expressions (1) and (2).

$$g/2\omega^2+(R\omega)^2/2g<(H-h) \quad (1)$$

(when $0<g<R\omega^2\leq 1$)

$$R<(H-h) \quad (2)$$

(when $1<g/R\omega^2$)

In the above, g is gravitational acceleration, R is a height of the rib 53 from the rotation center of the first feeding screw 25, ω is an angular velocity (rad/sec) of the first feeding screw 25, H is a distance from the bottom surface of the developing container 22 to the base (lower edge) of the developer discharge opening 40, and h is a distance between the bottom surface of the developing container 22 and the rotation center of the first feeding screw 25.

The above expressions (1) and (2) are condition expressions for preventing the raised developer from reaching the base of the developer discharge opening 40 in the case where the rib 53 provided on the first feeding screw 25 raises the developer.

As shown in FIG. 9, carrier particles of the developer are, at an end position of the rib 53, raised in the rotational direction of the rib 53 at an initial velocity of Rω.

When the rib 53 is rotated from the horizontal position by an angle θ, the height of the raised developer from the center axis of the first feeding screw 25 is R sin θ, and a vertical component of the initial velocity Rω is Rω cos θ.

Therefore, assuming that the developer is raised by the rib 53 when the rib 53 is located at the angle θ from the horizontal position, the following expression holds when a reaching height (vertical distance) is x.

$$d^2x/dt^2=g$$

This expression is solved and when the center of the screw shaft 52 is taken as reference, the following expression is obtained with the height $x=f(\theta)$.

$$f(\theta)=(R\omega\cos\theta)^2/2g+R\sin\theta$$

Here, when $0<g/R\omega^2\leq 1$, in a range of $0\leq\theta\leq 2\pi$ (rad), a maximum of f(θ) is $[g/2\omega^2+(R\omega w)^2/2g]$. Further, when $0<g/R\omega^2\leq 1$, in the range of $0\leq\theta\leq 2\pi$, the maximum of f(θ) is [R].

Therefore, in order to reliably prevent the raising of the developer by the rib 53, the above expressions (1) and (2) may only be required to be satisfied. More preferably, the screw blade may be partly cut away.

Incidentally, the above expressions (1) and (2) are a preferred example and in order to suppress the developer raising, the screw blade at the region opposing the developer discharge opening may be reduced in diameter.

However, when the small-diameter constitution is only employed, there is a possibility that the developer is stagnated at the discharge opening opposing portion and the developer discharging characteristic through the discharge opening becomes unstable. For this reason, in order to enhance the leveling effect, <β> at the small-diameter portion is made smaller than <β> at adjacent regions upstream and downstream of the small-diameter portion. It is more preferable that the above-described expressions (1) and (2) are satisfied.

In this embodiment, the angular velocity ω of the first feeding screw 25 is 800 rpm=83.7 (rad/sec), H is 18 (mm), h is 10 (mm), and the outer diameter of the screw shaft 52 is 4 (mm). When these values are substituted in the expression (1), the height R of the rib 53 for preventing the developer from being discharged through the developer discharge opening 40 is about 4.5 (mm) or less from the shaft axis, so that an amount of projection of the rib 53 from the surface of the screw shaft 52 may desirably be 2.5 (mm) or less as the height.

The first feeding screw 25 in Embodiment 1 with respect to the helical blade was not used but the rib 53 described above was provided at the region along the developer discharge opening 40 and the first feeding screw 25 in Comparative Embodiment 3 in which the helical blade was not used and the rib 53 was not provided were prototyped.

The developer discharging performance was compared between Embodiment 1 and Comparative Embodiment 3.

Parts (a) and (b) are graphs of the developer discharging characteristics in Embodiment 1 and Comparative Embodiment 3, respectively, wherein each solid line represents the developer discharging characteristic with respect to "unused initial developer" and each broken line represents the developer discharging characteristic with respect to "endurance developer after drive of the developing device 4*a* for 2 hours in high temperature/low humidity environment (45° C./39% RH)". The developer discharging characteristic is a developer discharge amount per unit time when the developer amount in the developing container 22 is expressed as a function. From the developer discharging characteristic, a developer discharge start point, a developer discharging speed and the like can be known.

With respect to the developer discharging characteristic, the discharge start point is particularly important as an index of improper coating of the developer on the developing sleeve 28. If there is no developer raising discharge by the first feeding screw 25, basically, the developer amount in the developing container 22 does not become smaller than that at the discharge start point.

Generally, the developer discharging characteristic is measured in the following manner.

(i) In a state in which the developing sleeve 28, the first feeding screw 25 and the second feeding screw 26 are driven at desired peripheral speeds, the developer is supplied into the developing container 22 until the developer is uniformly coated on the developing sleeve.

(ii) Until developer circulation in the developing container 22 is in a steady state, the developing sleeve 28, the first feeding screw 25 and the second feeding screw 26 are driven at the desired peripheral speeds (for 1 to 2 minutes in general).

(iii) From the time when the developer coating on the developing sleeve 28 becomes uniform, the developer is gradually added into the developing container 22 and the discharge amount per unit time at that time is measured. In Embodiment 2, the developer was added by 10 g for each addition and the discharge amount was measured for 30 sec to obtain the developer discharge amount per unit time.

As shown in (a) of FIG. 10, with respect to the first feeding screw 25 in Embodiment 1, the developer discharge through the developer discharge opening 40 is not effected when the amount of the developer in the developing container 22 is 250 g or less, so that the developer amount in the developing container 22 is not below 250 g. In Embodiment 1, compared with the initial developer, the discharge start point of the endurance developer is not substantially changed.

As shown in (b) of FIG. 10, with respect to the first feeding screw 25 in Comparative Embodiment 3, even when the developer amount in the developing container 22 is 250 g or less, intermittent developer discharge through the developer discharge opening 40 occurs, so that the developer amount in the developing container 22 can be below 250 g. In Comparative Embodiment 3, compared with the initial developer, the discharge start point of the endurance developer is lower by about 30 g.

As described above, in Embodiment 1, at the region opposing the developer discharge opening 40, the rib 53 with the height to the extent that the developer was raised but was not discharged through the developer discharge opening 40 was provided. As a result, the developer surface at the region opposing the developer discharge opening 40 was leveled, so that it became possible that the developer discharging characteristic for the endurance developer was also stabilized similarly as in the case of the initial developer. By providing the leveling member for leveling the developer surface at the region opposing the developer discharge opening 40, the developer surface at the region opposing the developer discharge opening 40 was uniformized even during the cumulation of the image formation, so that a difference in developer discharging characteristic between the initial developer and the endurance developer could be made small. As a result, from the initial state to during the cumulation of the image formation, the developing device 4*a* could stably discharge the developer through the developer discharge opening 40.

In the constitution in which there is no helical blade at the region opposing the developer discharge opening 40, the developer is stagnated at the region and thus the developer surface is raised and discharged through the developer discharge opening 40 so as to overflow. In such a constitution, by providing the leveling member which has no feeding force and is used for leveling the developer surface at the region opposing the developer discharge opening 40, the developer surface at the region opposing the developer discharge opening 40 is uniformized. As a result, the difference in developer discharging characteristic between the initial developer and the endurance developer is made small, so that the developer can be discharged stably from the state of the initial developer to the state of the endurance developer.

Embodiment 2

Figure 11A:
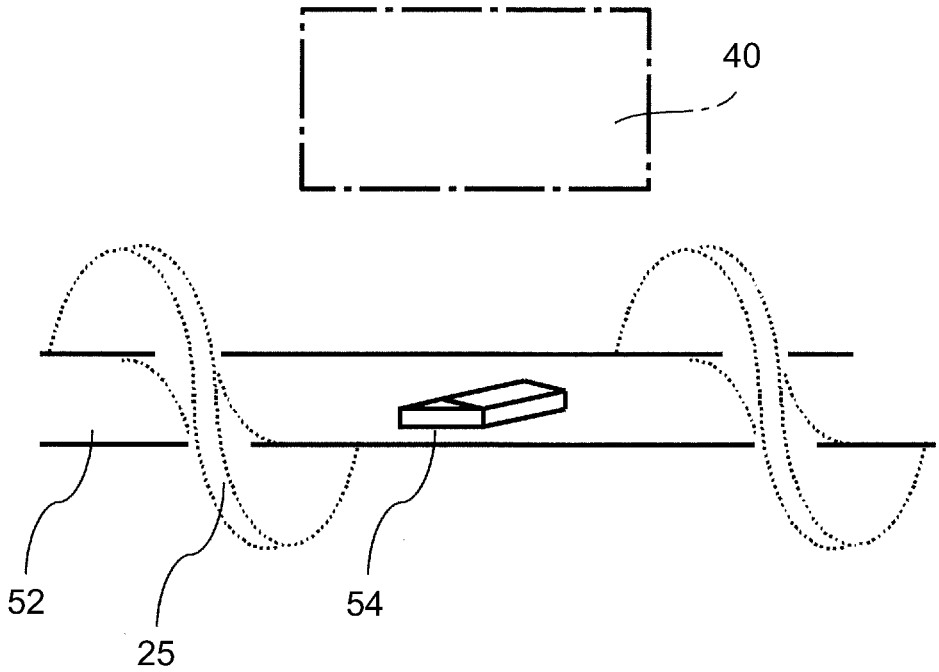

FIG. 11A is an illustrations of a structure of a first feeding screw in Embodiment 2. FIG. 8B is an enlarged view of a rib 54 in FIG. 11A. FIG. 11C is an enlarged top view of the rib portion in FIG. 11A. FIG. 11D is an enlarged front view of a rib portion in FIG. 11A. Parts (a) to (d) of FIG. 12 are graphs each showing a relationship between an inclination angle of an inclined surface of a rib and a discharging/stirring performance. In Embodiment 2, different from Embodiment 1 in which the rib has a rectangular cross section, the cross section of a rib has an upwardly projected roof-like shape. Other constitutions are the substantially same as those in Embodiment 1 and therefore constituent elements common to FIGS. 8A to 8C and FIG. 9 in Embodiment 1 and FIGS. 11A to 11D in Embodiment 2 are represented by the same reference numerals (symbols) and will be omitted from redundant description.

As shown in FIG. 1A1, in Embodiment 2, a rib 54 has the same cross section, having the upwardly projected roof-like shape, from its base portion contacting the screw shaft 52 to its end portion. The rib 54 has two inclined surfaces connected at a ridge thereof extending in a direction of diameter. The two inclined surfaces provide an interior angle is 90 degrees or more and 180 degrees or less.

A developer pushing surface (developer opposing surface) where the developer is pushed with rotation of the first feeding screw 25 has a height which is gradually lowered from a central portion toward an end portion of the rib 54. As a result, a vertical component of a force received by the developer from the rib 54 becomes small, so that compared with Embodiment 1, the developer is not readily raised and discharged through the developer discharge opening 40.

Figure 11B:
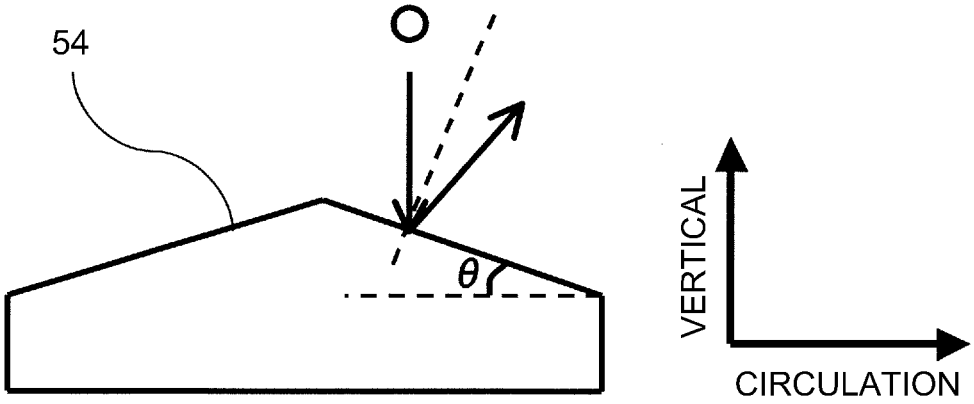
Figure 11C:
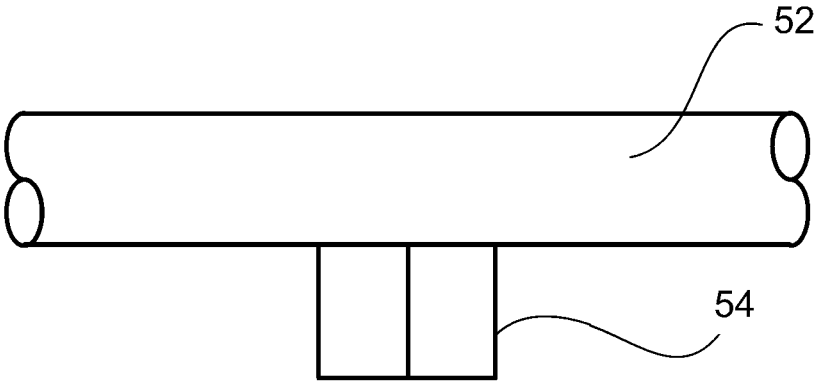
Figure 11D:
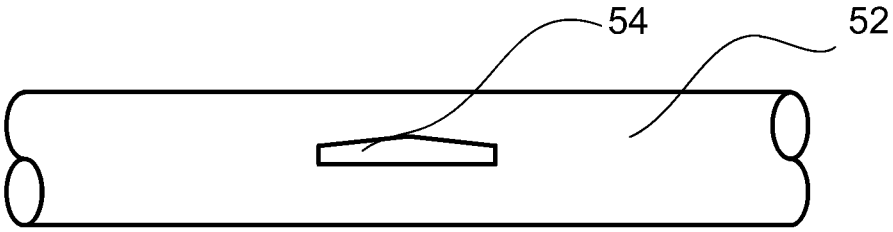

As shown in FIG. 11B, an inclined angle of the developer opposing surface of the rib 54 is θ. In Embodiment 1, this inclined angle θ is zero deg. In this embodiment, the developer receives, by the inclined surface of the rib 54, not only the force with respect to the vertical direction but also a force acting in a direction in which the developer is pushed and spreaded in its circulation direction (left-right direction in the figure), so that the developer surface can be leveled more efficiently than in Embodiment 1.

In this case, the disposition angle of the rib 54 coincides with the axis but the average angle $<\beta>$ of a developer feeding surface of the rib 54 has positive and negative values with respect to the ridge line of the upwardly projected roof-like shape and therefore also in this case, the average angle $<\beta>$ is zero deg. On the other hand, the average angle $<\beta>$ in each of the upstream and downstream regions is about 42 deg. since the pitch is 40 mm. That is, the average angle $<\beta>$ at the small-diameter portion which is the discharge opening opposing portion is made smaller than those at the upstream and downstream (adjacent) regions. For this reason, at the region opposing the discharge opening, the developer feeding effect with respect to the circumferential direction is increased relative to the developer feeding effect with respect to the axial direction, so that the developer leveling effect is obtained.

Similarly as in Embodiment 1, the gravitational acceleration is g, the distance (height) from the rotation center of the first feeding screw 25 to the (top) end of the rib 54 is R, the angular velocity of the first feeding screw 25 is ω, and the height (distance) from the rotation center of the first feeding screw 25 to the lower edge of the developer portion 40 is Hs. In this case, "$0<g/R\omega^2\leq 1$" and "$(g/2)\omega^2+(R\omega^2/2g<Hs$" are satisfied.

Then, a plurality of types of first feeding screws 25 different in inclined angle θ of the developer opposing surface of the rib 54 were prototyped. Each of the first feeding screws 25 with the different inclined angle θ of the developer opposing surface was mounted in the developing device 4*a* and was subjected to comparison of "level-off discharge property" of the developer through the developer discharge opening 40, "leveling force" for the developer with respect to the vertical direction, "leveling force" for the developer with respect to the feeding direction, and "developer leveling force" for the developer.

The "level-off discharge property" is a parameter which indicates a degree of difficulty of occurrence of the raising discharge of the developer by the rib 54. With a smaller "level-off discharge property", the raising discharge of the developer is liable to occur. With a larger "level-off discharge property", the raising discharge of the developer is desirably not readily caused.

The "leveling force" with respect to the vertical direction indicates a degree of leveling of the developer (surface) with respect to the vertical direction and is a force by which the developer is moved in the vertical direction by the developer opposing surface with the inclined angle θ. The "leveling force" with respect to the feeding direction indicates a degree of leveling of the developer (surface) with respect to the feeding direction (circulation direction) and is a force by which the developer is moved in the feeding direction by the developer opposing surface with the inclined angle θ. The "developer leveling force" indicates a degree of leveling of the developer (surface) by the rib 54 and is a total leveling force of the sum of the "leveling forces" with respect to the vertical direction and the feeding direction. Different from the rib 53 in Embodiment 1, the rib 54 has the inclined angle θ and therefore pushes (raises) the developer in not only the vertical direction but also the circulation direction.

In (a) to (d) of FIG. 12, the abscissa represents the inclined angle θ (deg.) and the ordinate represents the "level-off discharge property" ((a) of FIG. 12), the "leveling force" with respect to the vertical direction ((b), the "leveling force" with respect to the feeding direction ((c), the "developer leveling force" ((d)).

As shown in (a) of FIG. 12, the level-off discharge property has dependency of the inclined angle θ of the developer opposing surface. With an increasing angle θ, the developer is not readily raised and thus the level-off discharge property through the developer discharge opening 40 becomes large, thus being maximum at θ=45 deg. In a range of 45 deg.<θ<90 deg., the level-off discharge property does not depend on the angle θ while keeping the maximum. With an increasing angle θ from 0 deg., the vertical component of the force received by the developer from the rib 54 becomes smaller, and assuming that the incident angle and the reflection angle are the same, the vertical component is zero at θ=45 deg.

In the range of 45 deg.<θ<90 deg., the vertical component is directed downwardly and thus the rib 54 does not raise, the developer, so that the level-off discharge property is kept as it is at the maximum. In addition, the rib and the developer run against each other with a large angle and therefore the force is little transmitted from the rib 54 to the developer, so that an initial speed of the developer after receiving the force from the rib 54 becomes very low.

As shown in (b) of FIG. 12, with an increasing inclined angle θ of the developer opposing surface from 0 deg., the leveling force with respect to the vertical direction becomes smaller and is zero at θ=45 deg. With a larger angle θ, the raising force for raising the developer by the rib 54 with respect to the vertical direction becomes smaller and is zero at θ=45 deg., and then is directed downwardly in the range of 45 deg.<θ<90 deg.

As shown in (c) of FIG. 12, the leveling force with respect to the circulation direction is a maximum at θ=45 deg., and is a minimum at θ=0 deg. and at θ=90 deg. When the inclined angle θ of the developer opposing surface is 45 deg., the developer is pushed only in the circulation direction by the rib 54. At θ=0 deg., the developer is pushed (raised) only in the vertical direction. In the range of the inclined angle θ of the developer opposing surface from 45 deg. to 90 deg., an angle at which the developer is pushed in the circulation direction is gradually decreased, and at θ=90 deg., the developer passes through the developer opposing surface without stopping, so that the developer does not receive the force.

As shown in (d) of FIG. 12, the total developer leveling force is gradually increased in the range of 0 deg.≤θ≤45 deg., and is gradually decreased in the range of 45 deg.<θ<90 deg.

When the graphs of (a) and (d) of FIG. 12 are taken into consideration in combination, a range in which the "level-off discharge property" is good and the "developer leveling force" is large (i.e., a range in which the developer discharge amount by the raising is small and the developer surface can be efficiently leveled) is 0 deg., ≤θ≤45 deg., preferably θ=30 deg.

Figure 13A:
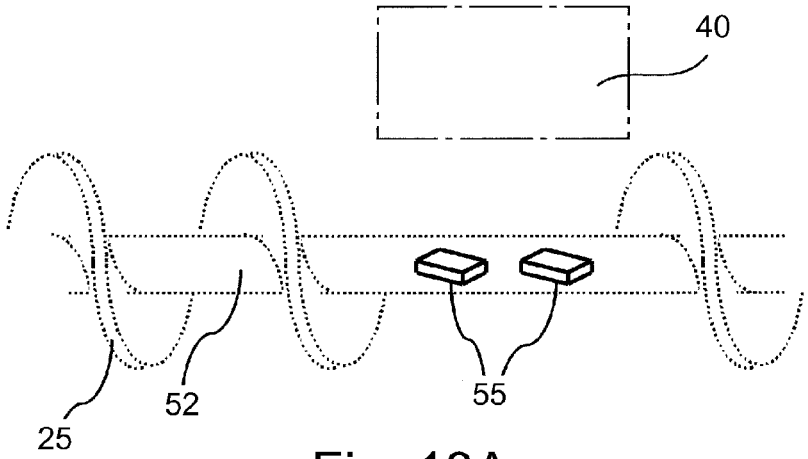
Figure 13B:
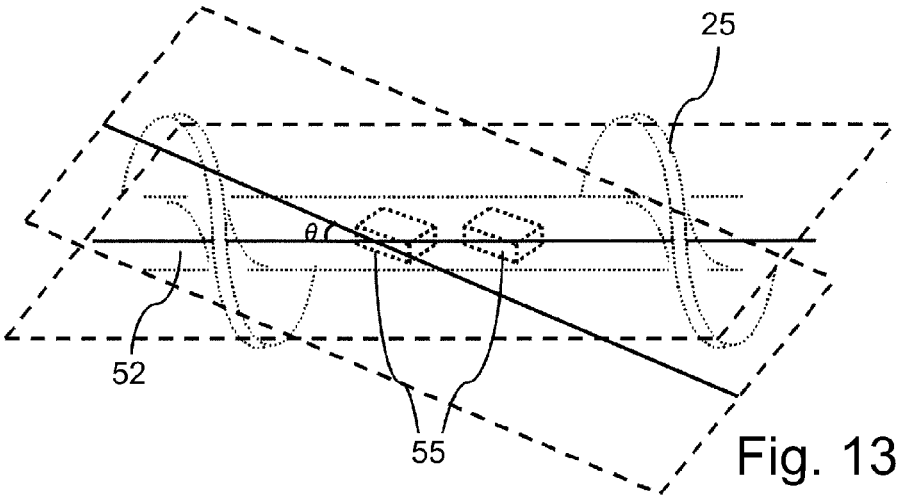
Figure 13C:
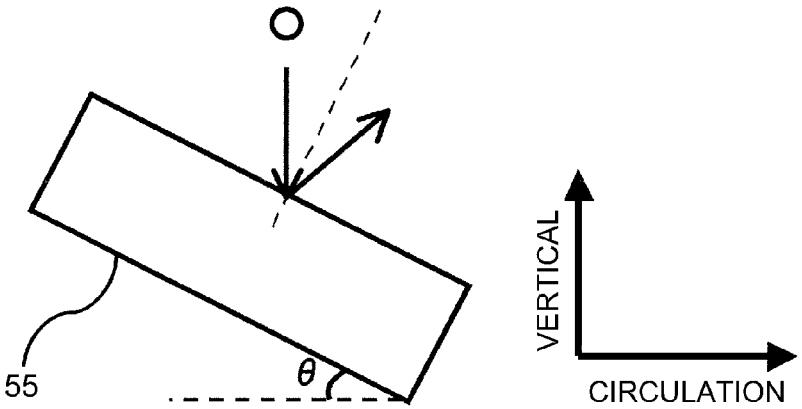
Figure 13D:
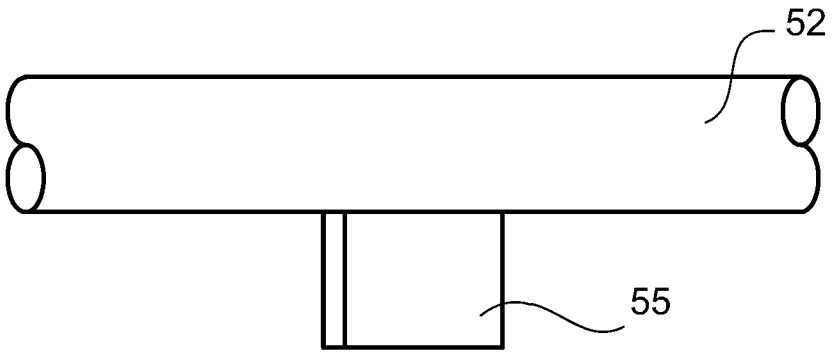
Figure 13E:
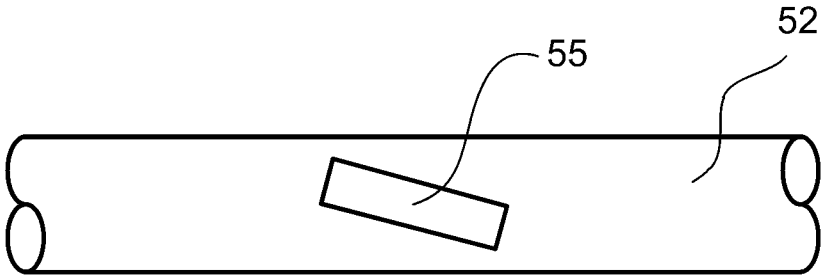

FIGS. 13A and 13B are illustrations of a structure of a first feeding screw in Embodiment 3. FIG. 13C is an enlarged view of a rib 55 in FIG. 13A. FIG. 13D is an enlarged top view of the rib portion in FIG. 13A. FIG. 13E is an enlarged front view of a rib portion in FIG. 13A. Parts (a) to (d) of FIG. 14 are graphs each showing a relationship between an inclination angle of an inclined surface of a rib and a discharging/stirring performance. In Embodiment 3, the rib 53 having the rectangular cross section in Embodiment 1 is inclined by the inclined angle θ with respect to the feeding direction and is used as a rib 55. Other constitutions are the substantially same as those in Embodiment 1 and therefore constituent elements common to FIGS. 8A to 8C and FIG. 9 in Embodiment 1 and FIGS. 13A to 13E in Embodiment 3 are represented by the same reference numerals (symbols) and will be omitted from redundant description.

A basic constitution in this embodiment is the same as that in Embodiment 1 and therefore elements having the same or corresponding functions and constitution as those in Embodiment 1 are represented by the same reference numerals or symbols and will be omitted from detailed description. In this embodiment, only a constitution portion peculiar to this embodiment will be described in detail. In Embodiment 1, the first feeding screw was provided with the rib having the height to the extent that the developer was not raised and discharged through the developer discharge opening at the region opposing the discharge opening, so that the developer surface of the region opposing the discharge opening was leveled and thus the developer discharging characteristic could be stabilized from the initial state to the durability state.

As shown in FIG. 13A, the rib 55 is formed in a region, of the first feeding screw along the developer discharge opening 40, in which the helical blade is not formed. As shown in FIG. 13B, the developer opposing surface of the rib 55 is not parallel to a flat surface including the shaft center line of the first feeding screw 25 and is inclined obliquely by the inclined angle θ. As shown in FIG. 13C, the developer opposing surface of the rib is inclined at the angle θ with respect to the feeding direction and therefore similarly as in Embodiment 2, the vertical component of the force received by the developer from the rib 55 becomes small.

In Embodiment 3, a single developer opposing surface is provided and therefore the inclined angle θ of the developer opposing surface is larger than that in the range of 0 deg.<θ<180 deg. in Embodiment 2 and can be selected from the range of 0 deg.<θ<180 deg.

Therefore, first feeding screws 25 different in inclined angle θ of the developer opposing surface of the rib 55 were prototyped. Each of the first feeding screws 25 with the different inclined angle θ of the developer opposing surface was mounted in the developing device 4*a* and was subjected to comparison of "level-off discharge property" of the developer through the developer discharge opening 40, "leveling force" for the developer with respect to the vertical direction, "leveling force" for the developer with respect to the feeding direction, and "developer leveling force" for the developer.

In (a) to (d) of FIG. 14, the abscissa represents the inclined angle θ (deg.) and the ordinate represents the "level-off discharge property" ((a) of FIG. 12), the "leveling force" with respect to the vertical direction ((b), the "leveling force" with respect to the feeding direction (circulation direction) ((c), the "developer leveling force" ((d)).

As shown in (a) of FIG. 14, in the range of the inclined angle θ of the developer opposing surface satisfying 0 deg.<θ≤45 deg., the "level-off discharge property" is gradually increased and becomes a maximum at θ=45 deg. In the range of 135 deg.<θ<180 deg., the "level-off discharge property" is gradually decreased.

As shown in (b) of FIG. 14, in the range of the inclined angle θ of the developer opposing surface satisfying 0 deg.<θ≤45 deg., the "leveling force" with respect to the vertical direction is gradually decreased and becomes zero at θ=45 deg. In the range of 135 deg.<θ<180 deg., the "leveling force" with respect to the vertical direction is gradually increased.

As shown in (C) of FIG. 14, in the range of the inclined angle θ of the developer opposing surface satisfying 0 deg.<θ≤45 deg., the "leveling force" with respect to the circulation direction is gradually increased and becomes a maximum at θ=45 deg. In the range of 45 deg.<θ<90 deg., the "leveling force" with respect to the circulation direction is gradually decreased.

Further, in the range of 90 deg.<θ≤135 deg., the "leveling force" with respect to the circulation direction is gradually increased and becomes a maximum at θ=45 deg. In the range of 135 deg.<θ<180 deg., the "level-off discharge property" is gradually decreased.

As shown in (d) of FIG. 14, the total developer leveling force is gradually increased in the range of 0 deg.≤θ≤30 deg., and is gradually decreased in the range of 30 deg.<θ<90 deg. Further, the total developer leveling force is gradually increased in the range of 90 deg.≤θ≤150 deg., and becomes a maximum at θ=150 deg. and is gradually decreased in the range of 150 deg.≤θ≤180 deg.

When the graphs of (a) and (d) of FIG. 12 are taken into consideration in combination, a range in which the "level-off discharge property" is good and the "developer leveling force" is large is 0 deg.,≤θ≤45 deg., and 135 deg.≤θ≤180 deg. preferably θ=30 deg. and θ=150 deg. In order to eliminate accumulation of the developer at the side upstream of the developer discharge opening 40, the range of 0 deg.≤θ≤90 deg. is preferred.

On the basis of the experimental results described above, in Embodiment 3, the rib 55 was shaped in a rectangular parallelepiped of 2 mm in height from the base contacting the screw shaft 52 of the first feeding screw 25, 3 mm in width with respect to the circulation direction of the developer, and 1 mm in thickness as seen in the rotational direction of the first feeding screw 25. The inclined angle θ of the developer opposing surface of the rib 55 was set at 30 deg. According to the first feeding screw 25 in this embodiment, similarly as in Embodiment 2, the possibility of the discharge of the developer by the raising is reduced and at the same time the developer can be efficiently leveled.

Further, in this case, <β> is i30 deg. and on the other hand <β> at the second region upstream and downstream of the discharge opening is about 42 deg., so that <β> at the region opposing the discharge opening is small. For this reason, at the region opposing the discharge opening, an effect of feeding the developer in the circumferential direction is increased relative to an effect of feeding the developer in the axial direction, so that the developer leveling effect is obtained.

In this embodiment, the rib surface which pushes the developer with the rotation of the first feeding screw 25 is the inclined surface which obliquely crosses the surface including the center axis of the first feeding screw 25. The crossing angle between the inclined surface and the surface including the center axis of the first feeding screw 25 is more than 0 deg. and 45 deg. or less.

Embodiment 4

Parts (a) to (c) of FIG. 15 are illustrations of a structure of a first feeding screw in Embodiment 4. In this embodiment, a constitution in which the rib 55 in Embodiment 3 is extended along the developer opposing surface so as to surround the screw shaft 52 of the first feeding screw 25 is employed. Other constitutions are the substantially same as those in Embodiment 3 and therefore constituent elements common to FIGS. 13A to 13E in Embodiment 3 and FIG. 15 in Embodiment 4 are represented by the same reference numerals (symbols) and will be omitted from redundant description.

As shown in (a) of FIG. 15, also in this embodiment, when a maximum of a distance of a disk (ring) member 56 from the shaft axis of the first feeding screw 25 is R, the relationship of the expression (1) described above is required to be satisfied. In this embodiment, as the leveling member, the disk member 56 with no feeding force is provided at the region opposing the developer discharge opening 40. The disk member 56 is rotated with the rotation of the first feeding screw 25 to vibrate the developer, thus leveling the developer present at the region opposing the developer discharge opening 40. The disk member 56 is a single plate disposed obliquely with respect to the screw shaft 52 and therefore, different from the helical blade, has no feeding force in the circulation direction. In addition, the disk member 56 is not connected with adjacent disk members 56 and therefore the abrupt change in discharge property resulting from the change in feeding force due to the developer deterioration as described above does not occur.

As shown in (b) of FIG. 15, also in this embodiment, when the inclined angle θ of the developer opposing surface is defined, similarly as in Embodiment 3, there is a tendency that the "developer leveling force" becomes smaller with an increasing θ and on the other hand, the "level-off discharge property" becomes a maximum in the neighborhood of θ=45 deg. For this reason, the inclined angle θ may preferably be in the range of 0 deg.≤θ≤45 deg. In this embodiment, the inclined angle θ was set at 30 deg.

As shown in (c) of FIG. 15, the disk member 56 has a shape such that the screw shaft 52 passes through the center of the disk member 56. The disk member 56 is cut along a slit R and is mounted around the screw shaft 52, and then is bonded to be integrated.

In this case, when the first feeding screw is rotated one turn, a circumferential portion of the disk member 56 is largely deflected in the thrust direction and therefore when <β> of the developer feeding surface is averaged through one turn of the first feeding screw, <β> becomes zero and thus the disk member 56 has no feeding force.

On the other hand, <β> at the second region upstream and downstream of the discharge opening is about 42 deg. since the pitch is 40 mm, so that <β> at the region opposing the discharge opening is certainly small. For this reason, at the region opposing the discharge opening, an effect of feeding the developer in the circumferential direction is increased relative to an effect of feeding the developer in the axial direction, so that the developer leveling effect is obtained.

In this embodiment, the inclined surface which stirs the developer with the rotation of the first feeding screw 25 is provided so as to surround the rotation shaft of the first feeding screw 25.

Embodiment 5

FIGS. 16 and 17 are illustrations of a leveling member for a first feeding screw in Embodiment 5. As shown in FIG. 17, Embodiment 5 is the same as Embodiment 1 in that a small-diameter rib is provided at the portion opposing the discharge opening. In this embodiment, the cross section of a rib 57 has a substantially elliptical shape, so that the rib cross section is gradually decreased with a position closer to its end with respect to its center.

In this embodiment, the screw shaft 52 is 3 mm in radius, a rib height R is 5 mm, h is 10 mm, and H is 18.5 mm.

The cross section of the rib 57 includes semicircular end portions each having a radius of 0.5 mm and is defined by tangential lines contacting the semicircles and the screw shaft 52. Further, the rib 57 is 8 mm in length with respect to the longitudinal direction, and the length of the discharge opening 40 is 10 mm. Longitudinal center positions of the rib 57 and the discharge opening 40 coincide with each other.

Also in the constitution in this embodiment, the cross-sectional shape of the rib is uniform with respect to the thrust direction and therefore the disposing angle of the rib 57 coincides with the axis, so that <β> becomes zero. On the other hand, <β> at the second region upstream and downstream of the discharge opening is about 42 deg. since the pitch is 40 mm, so that <β> at the region opposing the discharge opening is small. For this reason, at the region opposing the discharge opening, an effect of feeding the developer in the circumferential direction is increased relative to an effect of feeding the developer in the axial direction, so that the developer leveling effect is obtained.

Incidentally, in this embodiment the case where the longitudinal length of the rib 57 is shorter than that of the discharge opening 40 is described as an example but the present invention is not limited thereto. The longitudinal length of the rib 57 may also be longer than that of the discharge opening 40. In this case, the developer at the entire longitudinal region of the discharge opening opposing portion can be leveled.

In the developing device of the present invention, at the region along the discharge opening, there is no helical blade or the small-diameter helical blade is provided and therefore the raising and discharge of the developer through the discharge opening with the rotation of the helical blade is not readily caused. Further, under the developer at the region along the discharge opening, the developer feeding power in the rotational direction is higher than that at the adjacent regions and therefore the developer is locally stirred or vibrated at the discharge opening opposing discharge opening, so that the flowability of the developer is temporarily restored. As a result, the angle of repose of the developer becomes small, so that the raised portion of the developer is easily collapsed toward the side downstream of the discharge opening by its own weight. For this reason, the raised portion of the developer is not readily formed at the side upstream of the region along the discharge opening.

Therefore, even when the flowability of the developer is lowered, the raising of the developer fed along the discharge opening is suppressed and thus the developer is not readily discharged through the discharge opening, so that it is possible to avoid a large fluctuation in amount of the developer in the developing container.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 093902/2011 filed Apr. 20, 2011 and 065896/2012 filed Mar. 22, 2012, which are hereby incorporated by reference.

What is claimed is:

1. A developing device comprising:

a developer carrying member for carrying a developer comprising a toner and a carrier;

a developing container for accommodating the developer to be supplied to said developer carrying member;

a feeding screw, including a rotation shaft and a helical blade portion formed around the rotation shaft and provided in said developer container, for feeding the developer accommodated in said developing container, a discharge opening, provided opposite to said feeding screw, for permitting discharge of the developer accommodated in said developing container; and a supply port for supplying the developer to said developing container, wherein said feeding screw is provided with a projected portion projecting from the rotation shaft in a radial direction of the rotation shaft at a position opposing the discharge opening, wherein said projected portion has a flat surface portion, wherein a height of said projected portion from the rotation shaft in the radial direction is lower than a height of said helical blade portion from said rotation shaft in the radial direction, and wherein when gravitation acceleration is g, a distance from a rotation center of said feeding member to a free end of said projected portion is R, angular velocity of said feeding screw is ω, and a height from the rotation center of said feeding screw to a lower edge of said discharge opening is Hs, the following relationships are satisfied:

$$0<g/R\omega^2\leq 1, \text{ and}$$

$$((g/2)\omega^2(R\omega))^2/2g)<Hs.$$

2. The device according to claim 1, wherein said projected portion has a substantially elliptical shape in cross-section perpendicular to said rotation shaft, and the shape of said projected portion is a rotation locus drawn by the substantially elliptical shape when the substantially elliptical shape moves along the axial direction of said rotation shaft.

3. The device according to claim 1, wherein said projected portion includes a second flat surface portion inclined with respect to said rotation shaft.

4. The device according to claim 1, wherein with respect to a cross-section perpendicular to a rotational axis of said rotation shaft, a cross-sectional width of said projected portion proximate to said rotation shaft is larger than a cross-sectional width of said projected portion at a free end thereof.

5. The device according to claim 1, wherein said projected portion is formed so as to project in not only a first direction crossing a direction of the rotational axis but also an opposite direction to the first direction.

6. The device according to claim 1, wherein a maximum height of a free end of said projected portion through one full turn of said feeding screw is lower than a lower edge of said discharge opening.

7. The device according to claim 6, wherein an angle formed between the flat surface portion and a plane including a rotational axis of said rotation shaft is 0 degrees or more and 45 degrees or less.

8. The device according to claim 6, wherein an angle formed between said flat surface portion and a plane including a rotational axis of said rotation shaft is smaller than an angle formed between a feeding surface of said helical blade portion and the plane including the rotational axis of said rotation shaft.

9. The device according to claim 6, wherein said flat surface portion is parallel to the rotation axis of the rotation shaft.

10. The device according to claim 6, wherein said rib is formed so as to project in a first direction crossing a direction of a rotational axis of said rotation shaft and also in an opposite direction to the first direction.

11. The developing device comprising:

a developer carrying member for carrying a developer comprising a toner and a carrier;

a developing container for accommodating the developer to be supplied to said developer carrying member;

a feeding screw, including a rotation shaft and a helical blade portion formed around said rotation shaft and provided in said developer container, for feeding the developer accommodated in said developing container;

a discharge opening, provided opposite to said feeding screw, for permitting discharge of the developer accommodated in said developing container;

a supply port for supplying the developer to said developing container; and a rib that is provided on said rotation shaft of said feeding screw at a position opposing said discharge opening, wherein a height of said rib from said rotation shaft with respect to the radial direction is lower than a height of said helical blade portion from said rotation shaft with respect to the radial direction, and wherein as seen in a direction of a rotational axis of said rotation shaft, a width of said rib gradually decreases from a base of said rib toward a free end of said rib with an increasing distance from said rotation shaft, and as seen in a direction perpendicular to the rotational axis of said rotation shaft, said rib has rectangular surfaces.

12. The device according to claim 11, wherein when said feeding screw is rotated one turn, a maximum height of a free end of said rib is lower than a lower edge of said discharge opening.

13. The device according to claim 11, wherein when gravitation acceleration is g, a distance from a rotation center of said feeding member to a free end of said rib is R, angular velocity of said feeding screw is co, and a height from the rotation center of said feeding screw to a lower edge of said discharge opening is Hs, the following relationships are satisfied:

$$0<g/R\omega^2\leq 1, \text{ and}$$

$$((g/2)\omega^2+(R\omega)^2/2g)<Hs.$$

* * * * *